US008381750B2

(12) United States Patent
Desouches et al.

(10) Patent No.: US 8,381,750 B2
(45) Date of Patent: Feb. 26, 2013

(54) HUNTING BLIND HAVING A CAMOUFLAGING SLOPED PROFILE

(75) Inventors: Thomas Desouches, Kowloon (HK); Timothy Parsons, Novato, CA (US)

(73) Assignee: P&T Products, Ltd., Novato, CA (US)

( * ) Notice: Subject to any disclaimer, the term of this patent is extended or adjusted under 35 U.S.C. 154(b) by 0 days.

(21) Appl. No.: 12/628,970

(22) Filed: Dec. 1, 2009

(65) Prior Publication Data

US 2011/0126873 A1 Jun. 2, 2011

(51) Int. Cl.
*E04H 15/54* (2006.01)

(52) U.S. Cl. ..... 135/115; 135/901

(58) Field of Classification Search ..... 135/115, 135/901; 43/1–3
See application file for complete search history.

(56) References Cited

U.S. PATENT DOCUMENTS

| | | | | |
|---|---|---|---|---|
| 2,816,297 | A | 11/1955 | Stanley | |
| 3,638,257 | A | 2/1972 | Ernst | |
| 4,751,936 | A * | 6/1988 | Zibble et al. | 135/117 |
| 4,858,634 | A * | 8/1989 | McLeese | 135/126 |
| 5,579,794 | A * | 12/1996 | Sporta | 135/88.01 |
| D379,961 | S | 6/1997 | Cripe | |
| 5,647,159 | A | 7/1997 | Latschaw | |
| 5,711,336 | A * | 1/1998 | Nirmel | 135/87 |
| D405,890 | S | 2/1999 | Latschaw | |
| 5,941,264 | A | 8/1999 | Gregg | |
| 6,668,749 | B2 | 12/2003 | Fargason | |
| 6,694,995 | B1 | 2/2004 | Ransom | |
| 6,698,131 | B2 | 3/2004 | Latschaw | |
| 6,938,632 | B2 | 9/2005 | Coursey | |
| 7,237,283 | B2 | 7/2007 | Devries | |
| D572,371 | S | 7/2008 | Desouche et al. | |
| 2004/0231221 | A1 | 11/2004 | Latschaw | |
| 2006/0096630 | A1 * | 5/2006 | Eastman et al. | 135/115 |
| 2008/0099060 | A1 * | 5/2008 | Stocking et al. | 135/115 |

* cited by examiner

*Primary Examiner* — Noah Chandler Hawk
(74) *Attorney, Agent, or Firm* — Brian Beverly; Beeson Skinner Beverly, LLP

(57) ABSTRACT

A skirt for a lay-down type hunting blind of the type having a shell for enclosing an occupant in a recumbent position. The skirt comprises at least one panel having a proximate edge and a distal edge. The proximate edge of the skirt attaches to the top perimeter edge of the shell. The skirt's distal edge is securable to a ground surface such that the skirt may be extended outwardly from the top perimeter edge of the shell to a ground surface at a slope sufficiently gradual to minimize shadows and blend more naturally into outdoor environments.

15 Claims, 23 Drawing Sheets

HUNTING BLIND HAVING A CAMOUFLAGING SLOPED PROFILE

FIELD OF THE INVENTION

This invention relates to a hunting blind, and particularly to a portable lay-down type hunting blind having a gradually sloped profile that minimizes shadows cast by the sun and camouflages the blind. In one embodiment, a skirt having a sloped profile is provided for detachable attachment to a lay-down type hunting blind. Another embodiment of the invention incorporates a collapsible housing for a dog.

BACKGROUND

Lay-down type hunting blinds are widely used by waterfowl hunters. This type of hunting blind is readily portable, easy to set up in a relatively flat location, and permits the occupant to assume a recumbent position in the blind. As deployed in the field, a lay-down blind has an elongated configuration forming an enclosure. A pair of cooperating longitudinal doors on the top side of the blind affords access to the enclosure's interior. While in the blind with its doors closed, an occupant is effectively concealed from view. When an object of interest approaches, the occupant can throw open the blind doors using his or her hands and arms, abruptly sit up, and take appropriate action such as firing a weapon.

One disadvantage with existing lay-down type hunting blinds is that shadows are created when light strikes them at lower angles. The substantially vertical portions of the sides of these blinds cast shadows which can deter approaching prey. Another problem encountered with these type of blinds is that they appear as abrupt angular changes appear out of place in the terrain which tend to ward off prey.

Thus, there is a need for a lay-down type hunting blind having a profile that minimizes shadows cast and maximizes the appearance of safety to waterfowl flying in the vicinity of the blind.

BRIEF DESCRIPTION OF THE ILLUSTRATIONS

Figure 3A:
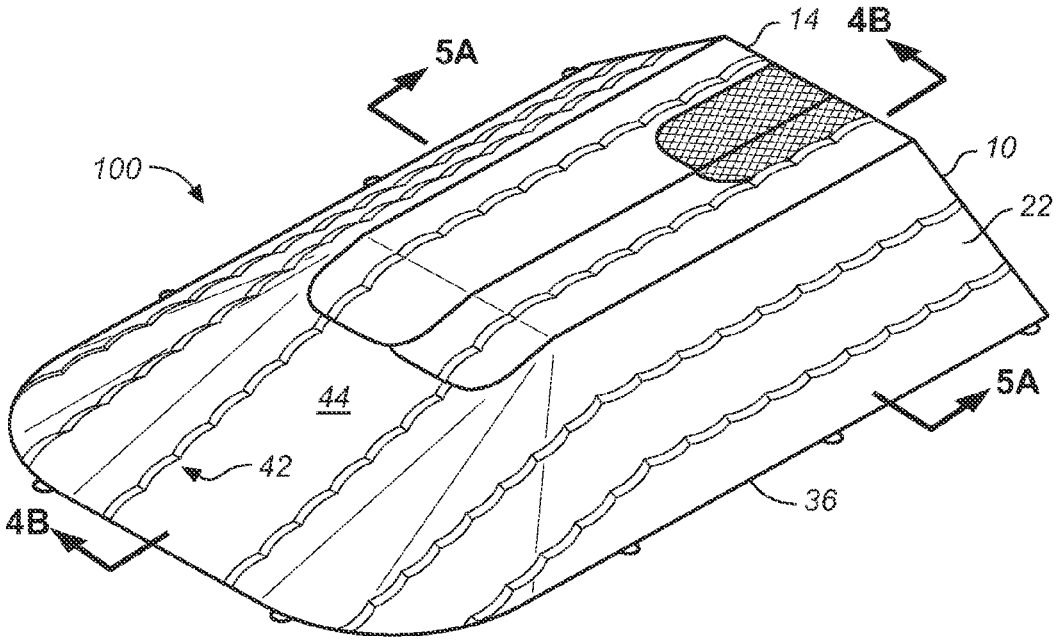
FIG. 3A is an upper perspective view of a hunting blind comprising a lay-down type hunting blind enclosure and a fully integrated skirt according to the invention.
Figure 3B:
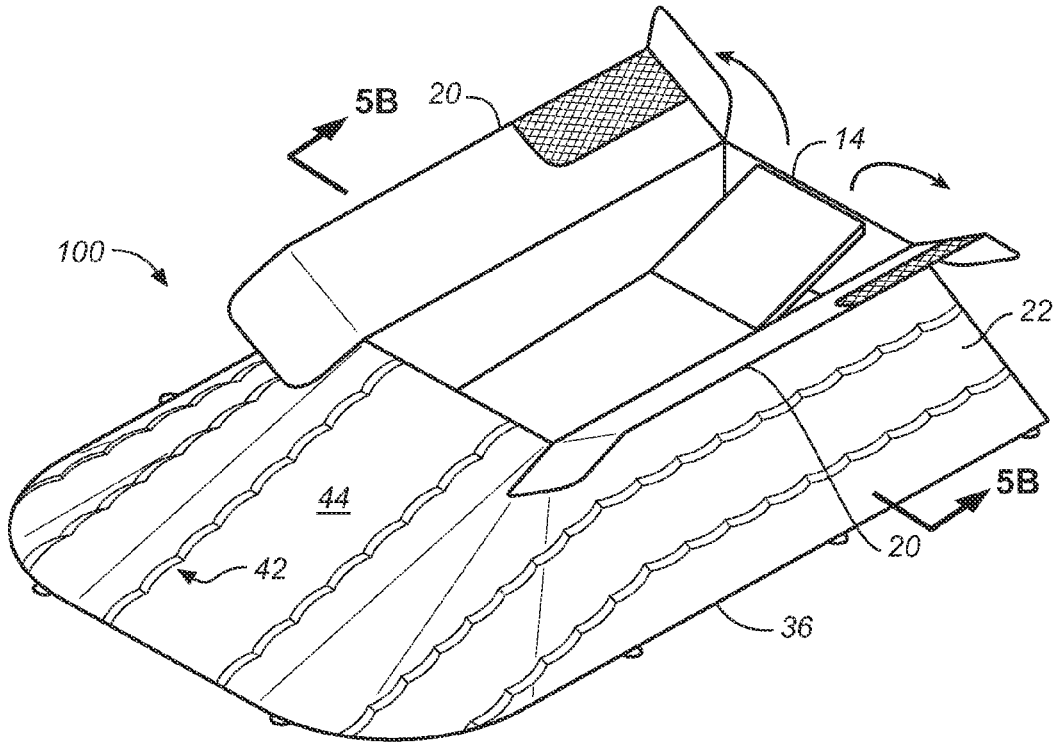

FIG. 3B an upper perspective view of the hunting blind shown in FIG. 3A with the flap doors open showing a portion of the enclosure's interior.

Figure 1A:
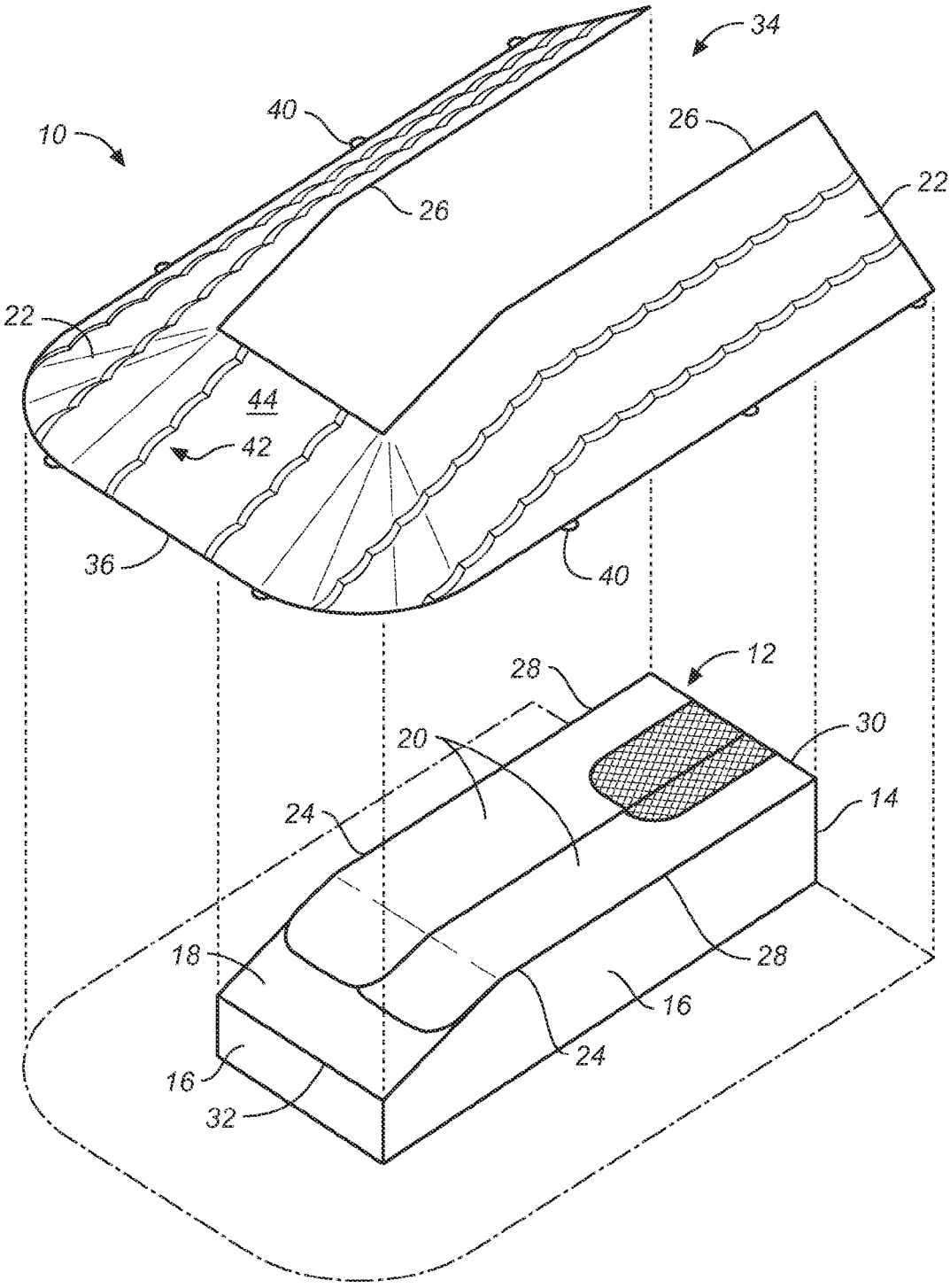
FIG. 1A is an exploded upper perspective view of a skirt according to the invention and a generic representation of a lay-down type hunting blind enclosure to which the skirt can be attached.
Figure 1B:
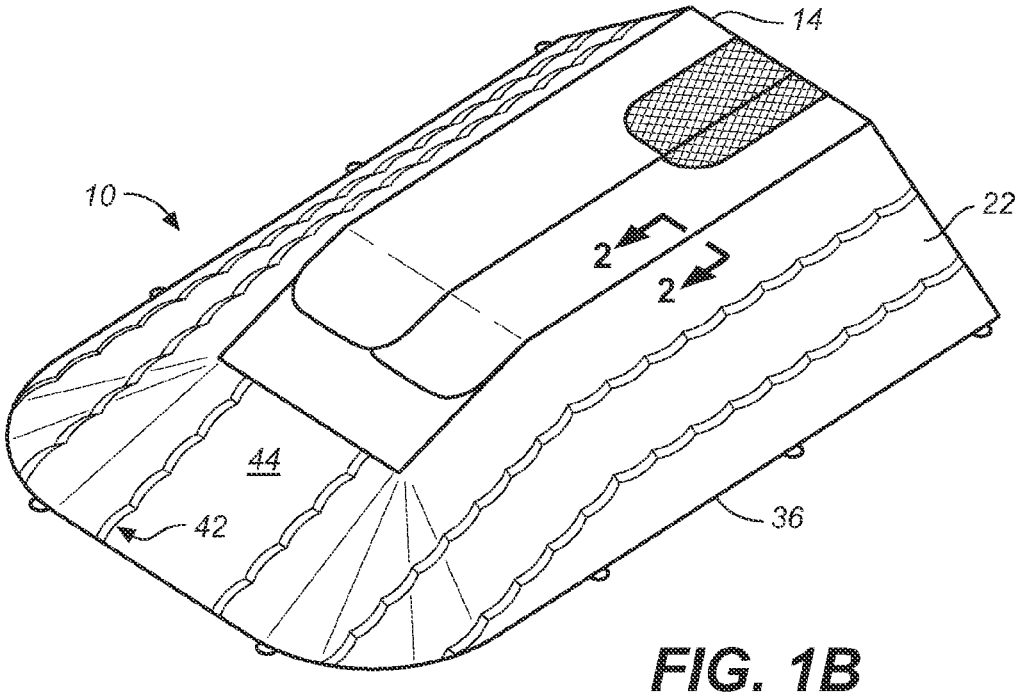
FIG. 1B is an upper perspective view of the skirt and hunting blind enclosure shown in FIG. 1A in an assembled configuration.
Figure 4A:
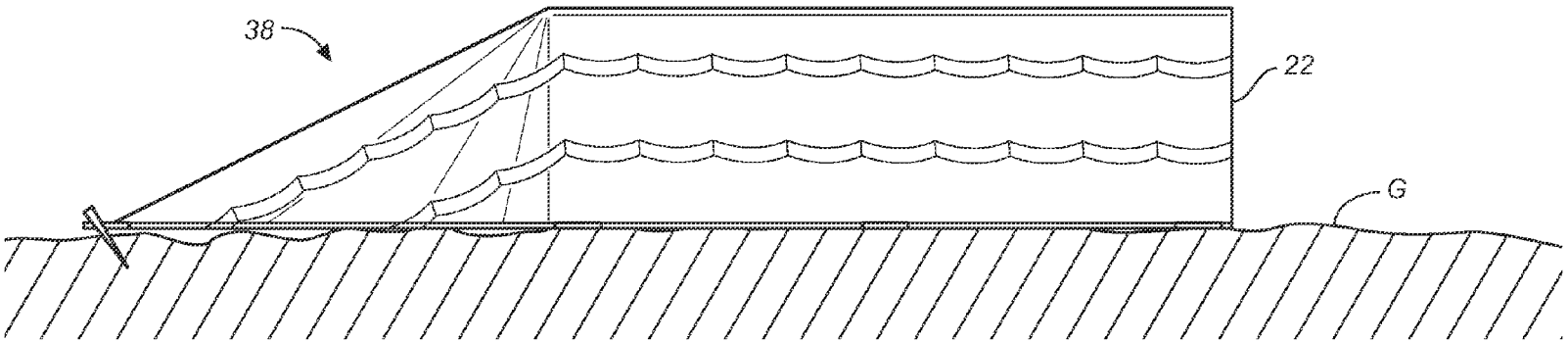

FIG. 4A is a side elevational view of the hunting blind shown in FIG. 1B.

Figure 4B:
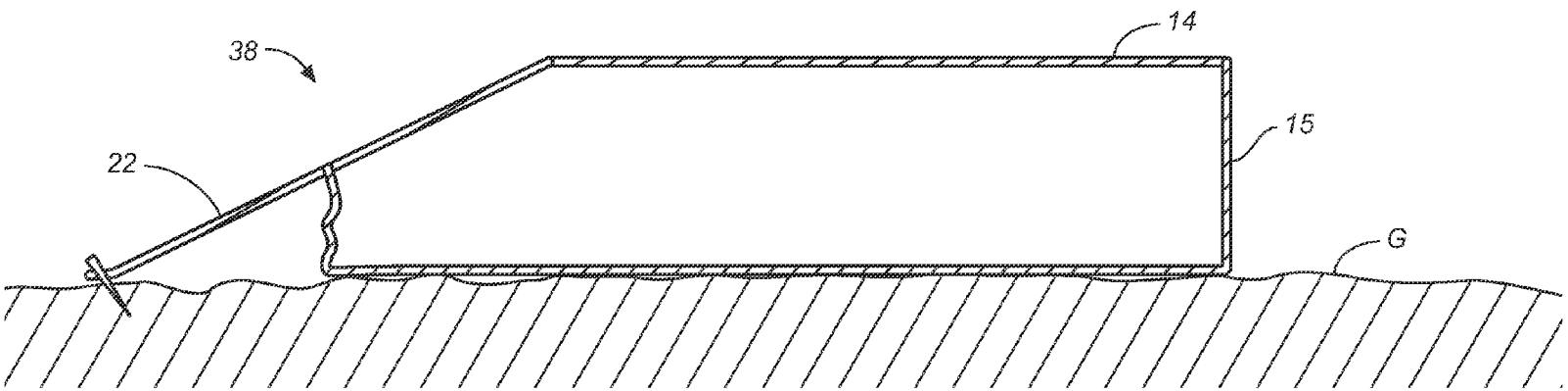

FIG. 4B is a longitudinal-sectional view of the hunting blind shown in FIG. 3A taken along lines 4B-4B.

Figure 5A:
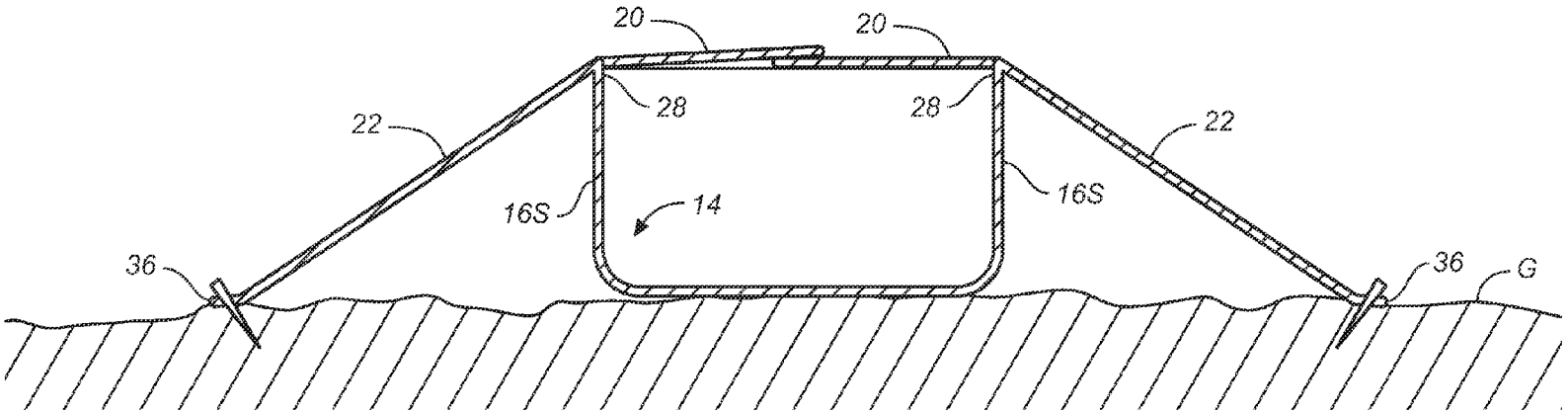

FIG. 5A is a cross-sectional view of the hunting blind shown in FIG. 3A taken along lines 5A-5A.

Figure 5B:
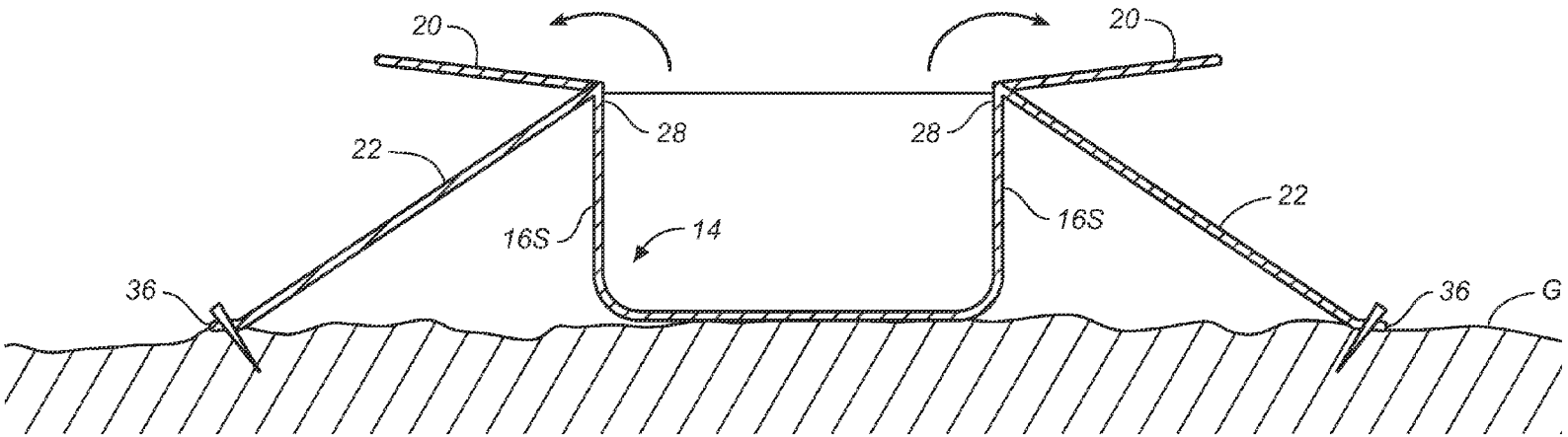

FIG. 5B is a cross-sectional view of the hunting blind shown in FIG. 3B taken along lines 5B-5B, depicting the flap doors in the open position.

Figure 6:
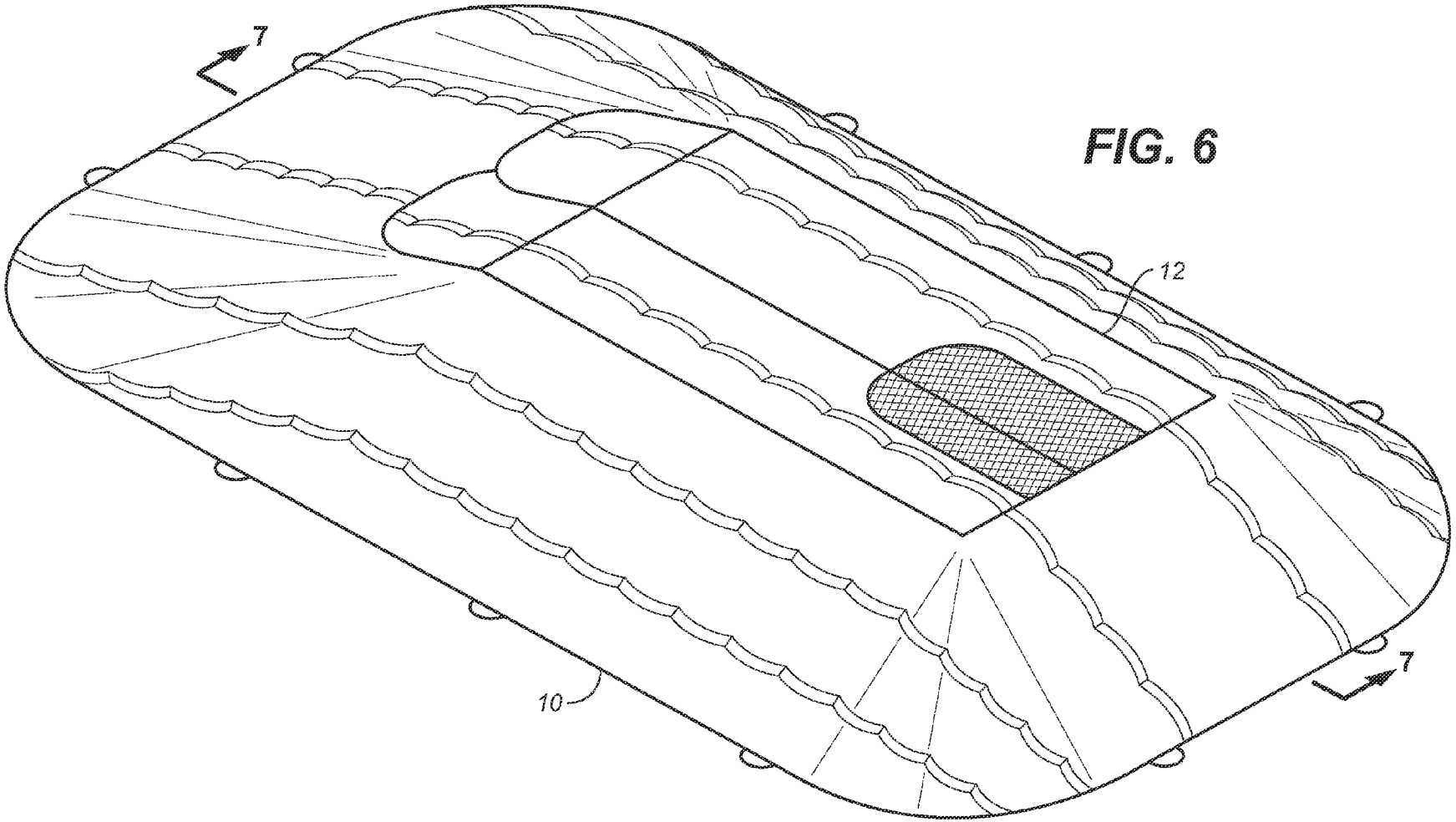

FIG. 6 is an upper perspective view of another embodiment of a hunting blind according to the invention similar to that shown in FIG. 3A but showing the skirt extending completely around the enclosure.

Figure 6A:
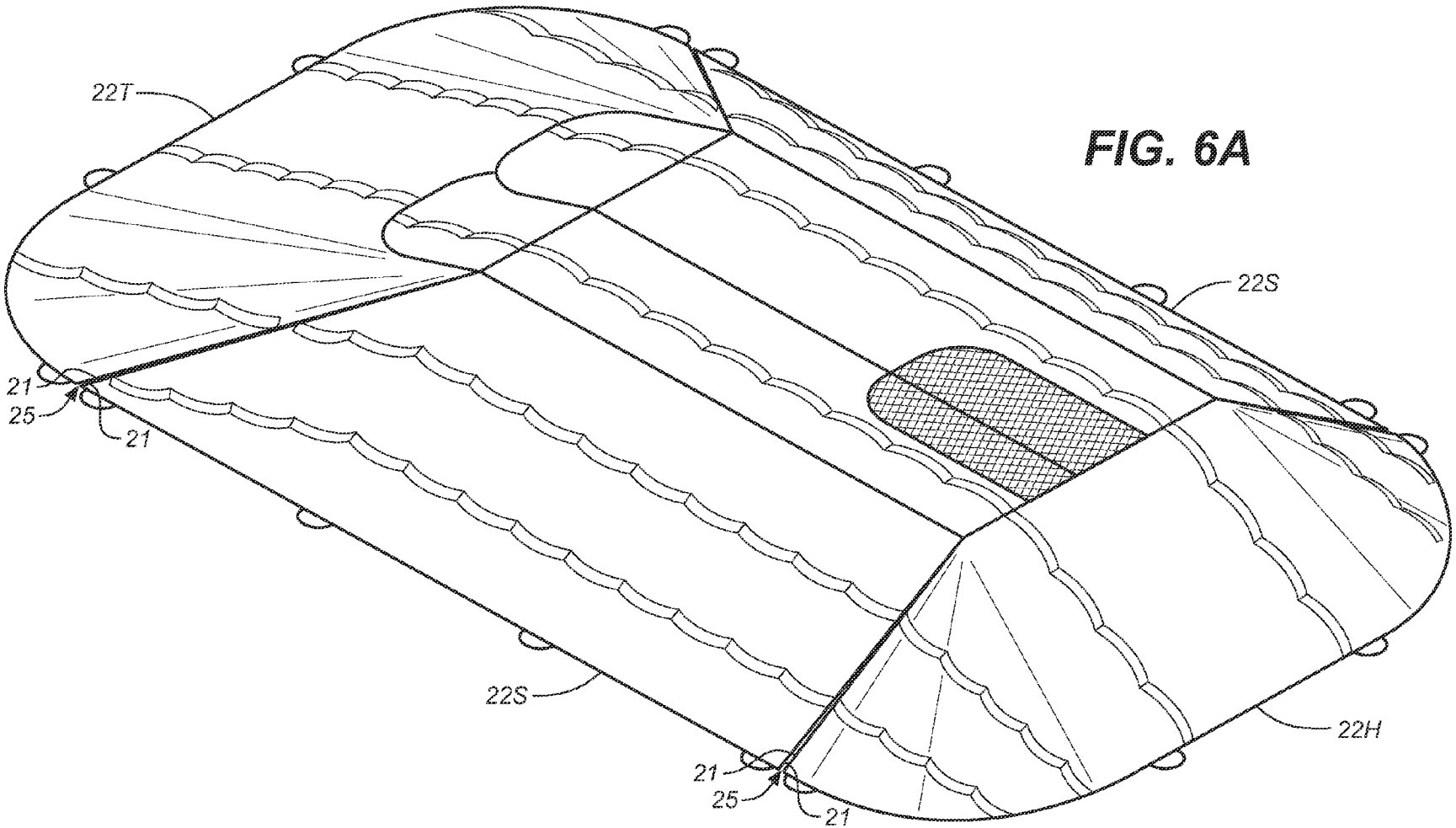

FIG. 6A is an upper perspective view of another embodiment of a hunting blind similar to that shown in FIG. 1, but showing the skirt being comprised of separate head end, side and toe end panels.

Figure 7:
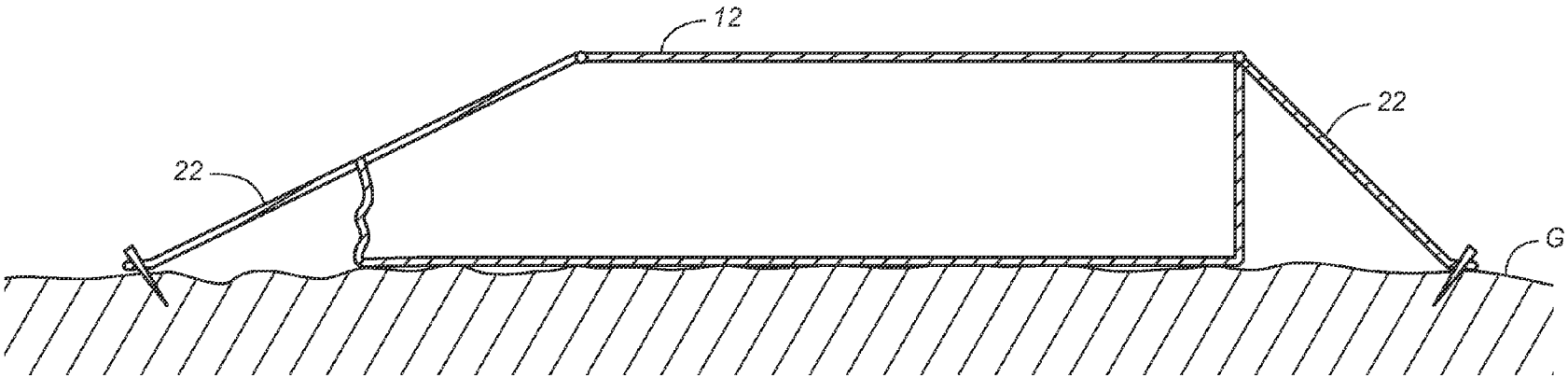

FIG. 7 is a longitudinal-sectional view of a hunting blind similar to that shown in FIG. 4B, showing a skirt extending from the head and toe ends of the hunting blind enclosure.

Figure 8A:
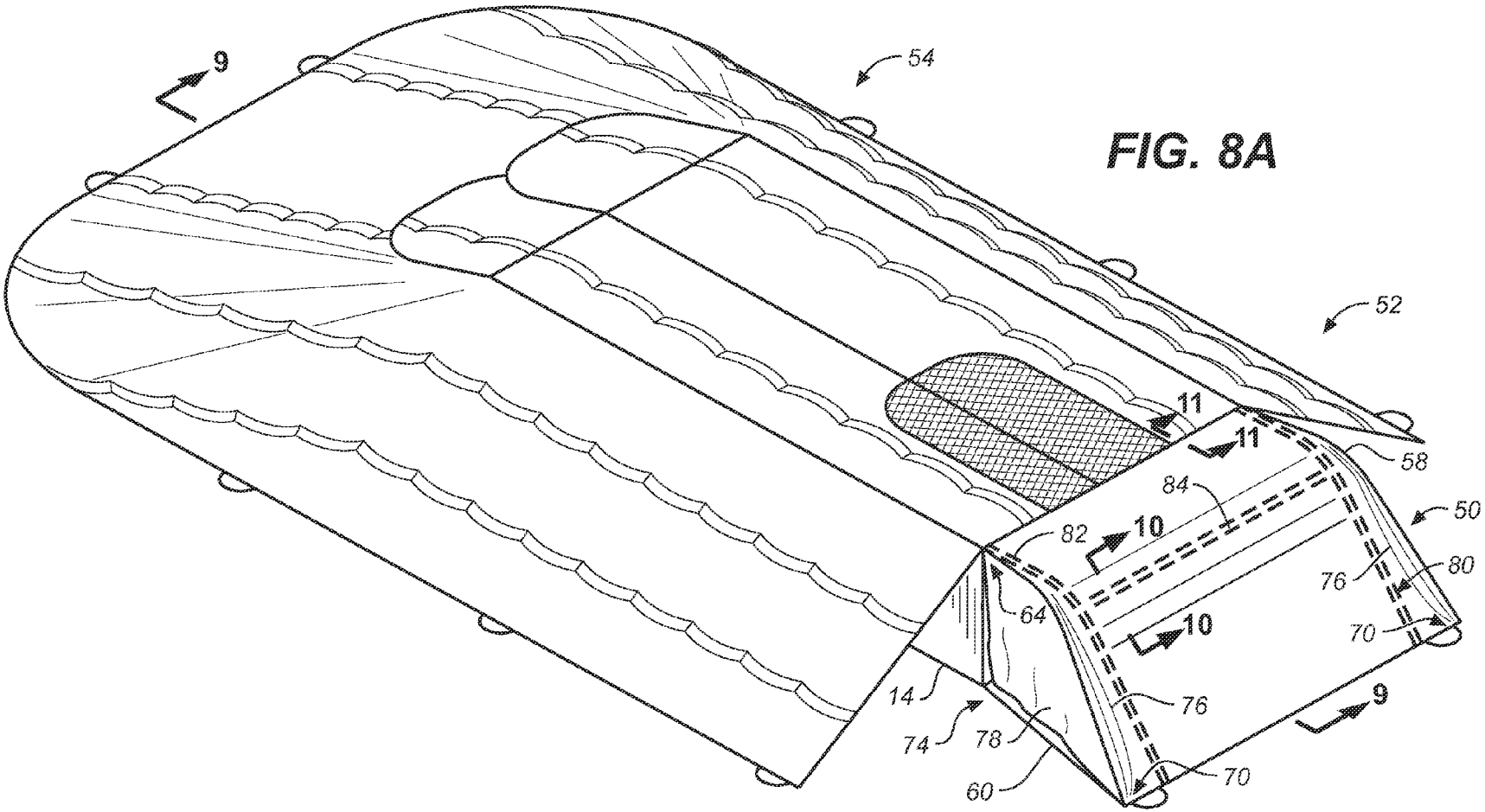

FIG. 8A is an upper perspective view of hunting blind similar to that shown in FIG. 1B, but with a foldable housing at the head end of the hunting blind enclosure.

Figure 8B:
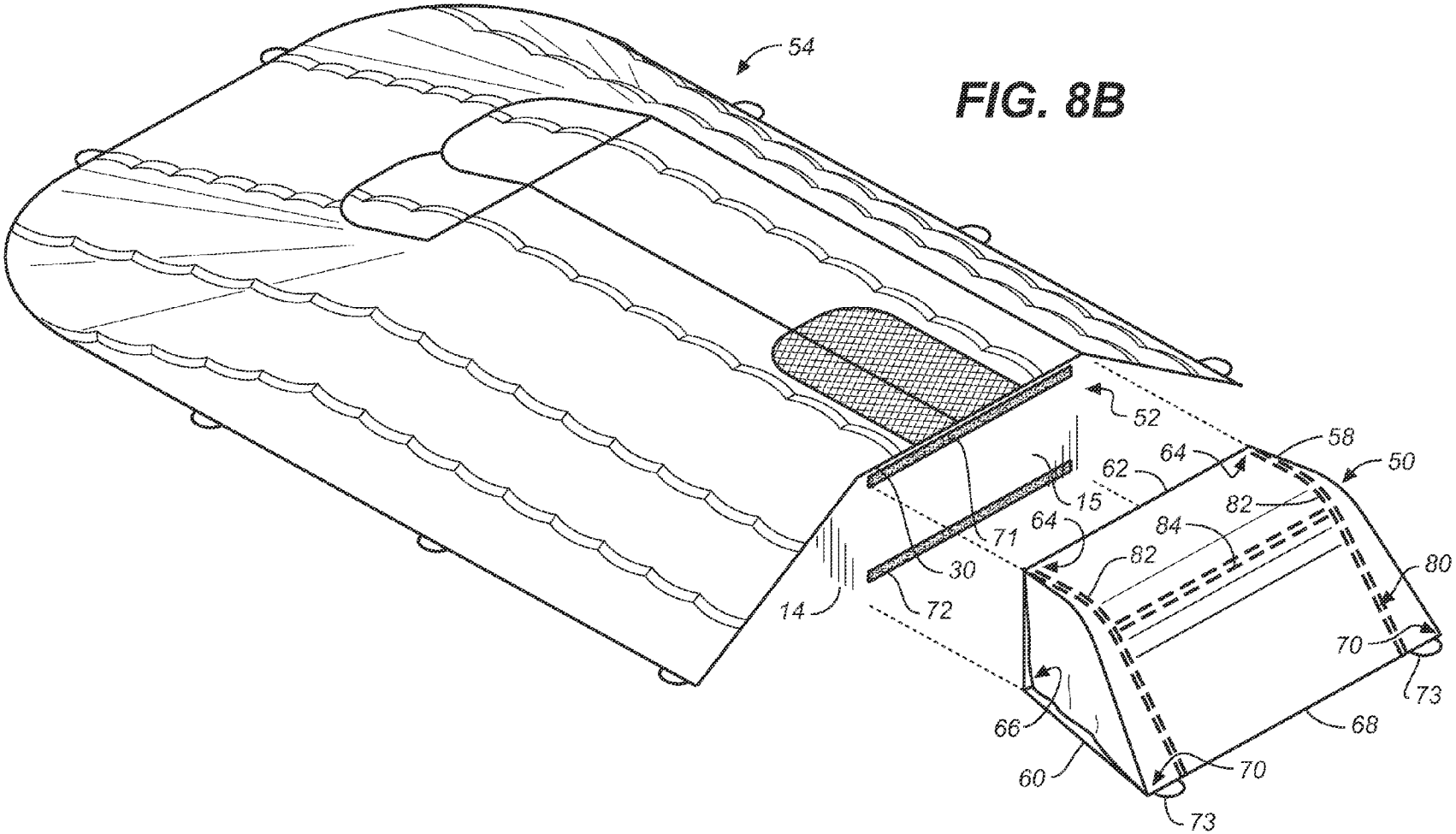

FIG. 8B is an exploded upper perspective view of the hunting blind shown in FIG. 8A.

Figure 9:
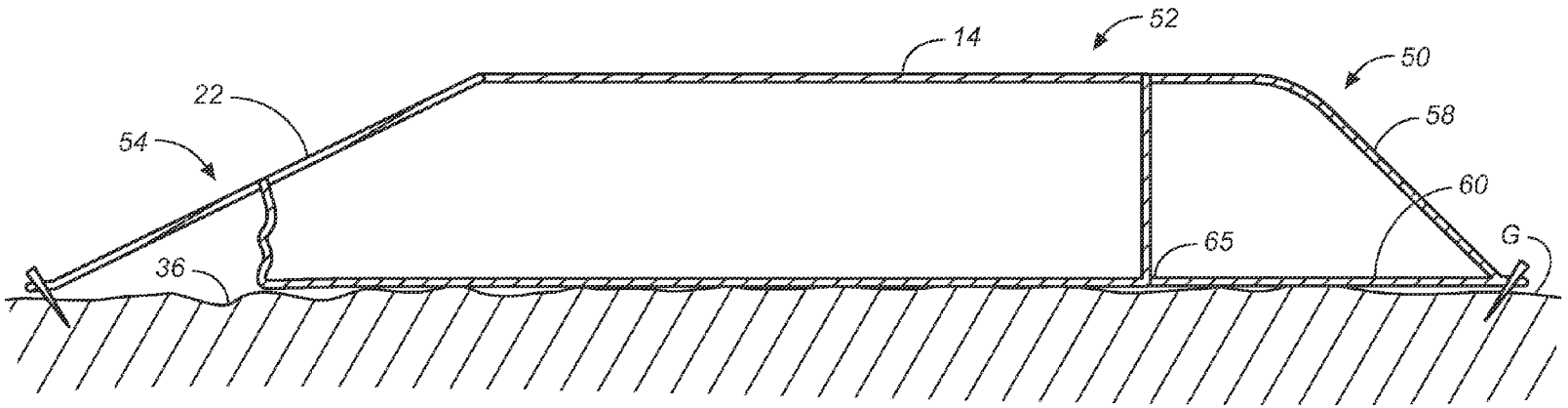

FIG. 9 is a longitudinal-sectional view of the hunting blind shown in FIG. 8A taken along lines 9-9.

Figure 10:
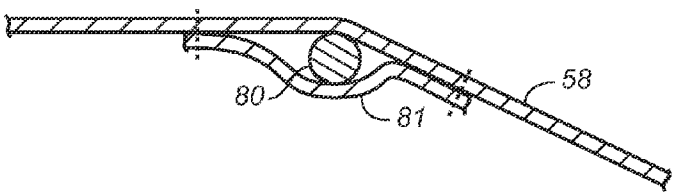

FIG. 10 is cross-sectional view of a portion of the hunting blind shown in FIG. 8A taken along lines 10-10.

Figure 11:
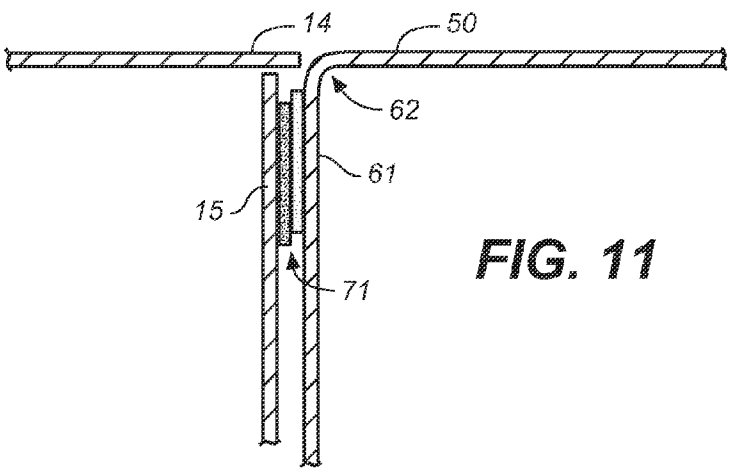

FIG. 11 is cross-sectional view of a portion of the hunting blind shown in FIG. 8A taken along lines 11-11.

Figure 12B:
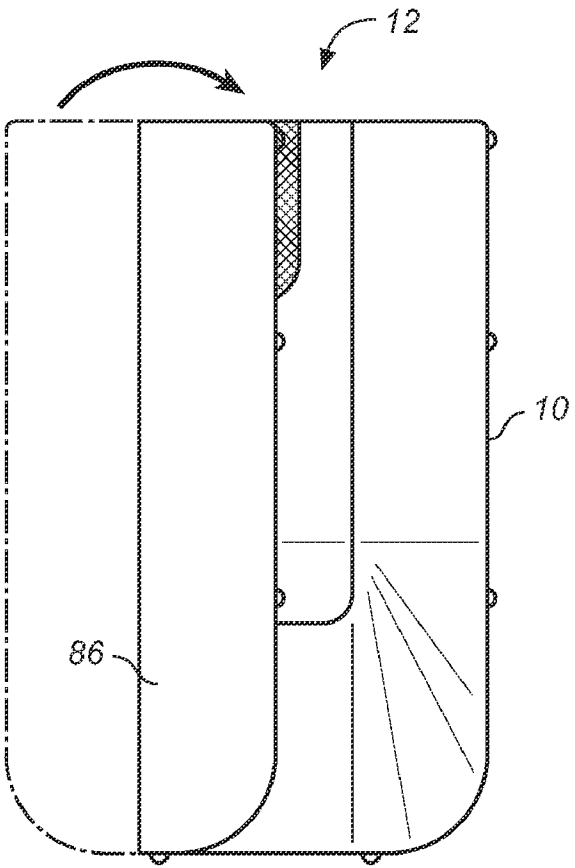
Figure 12A:
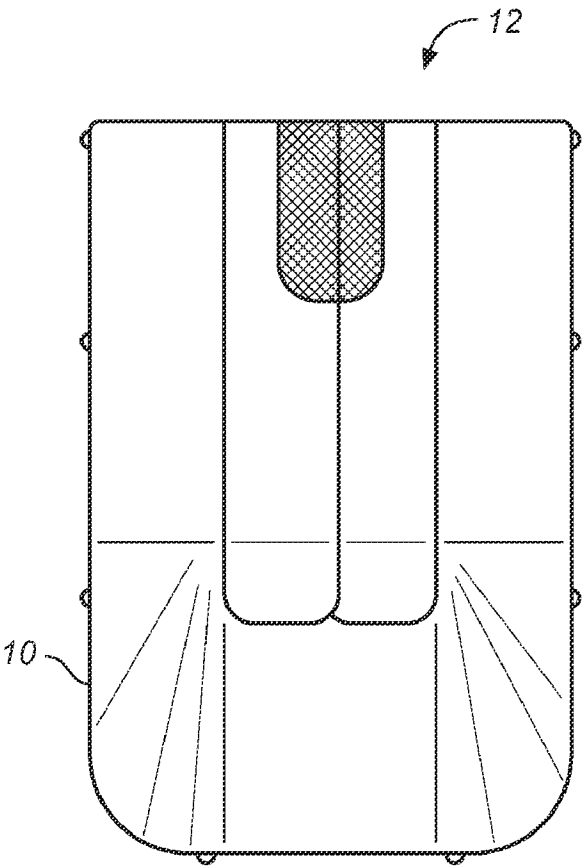

FIG. 12A is a top plan view of a hunting blind similar to that shown in FIG. 3A.

FIG. 12B is a top plan view of the hunting blind shown in FIG. 12A, showing a first portion of the skirt folded over and partially overlapping the flap doors on the enclosure's shell.

Figure 12F:
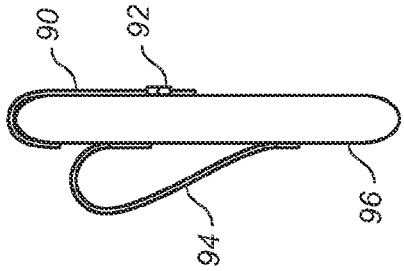
Figure 12E:
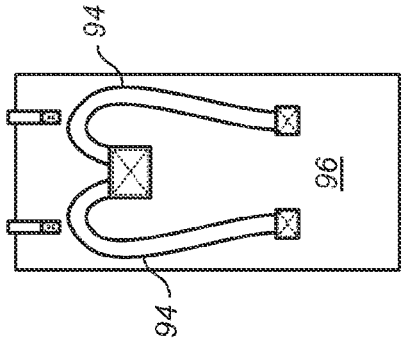
Figure 12D:
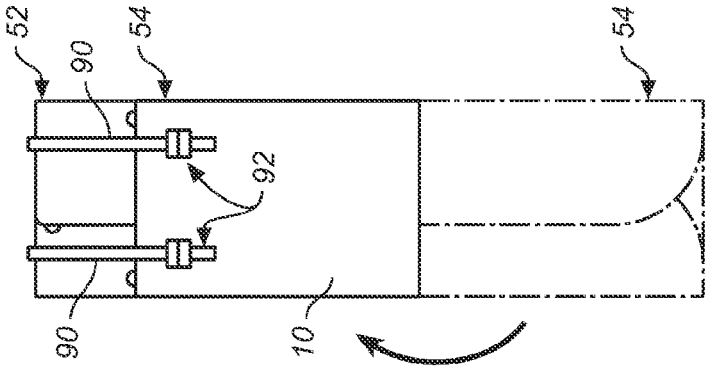
Figure 12C:
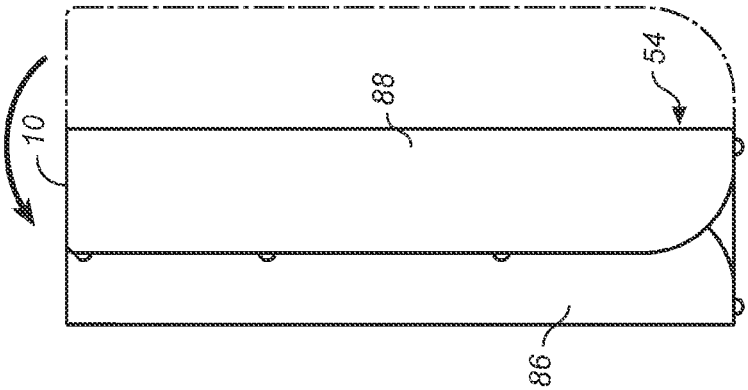

FIG. 12C is a top plan view of the hunting blind shown in FIG. 12B, showing a second portion of the skirt folded over and overlapping the first portion.

FIG. 12D is a top plan view of the hunting blind shown in FIG. 12C, showing the bottom half of the folded blind folded over onto and attached to the top half of the enclosure.

FIG. 12E is a bottom plan view of the hunting blind shown in FIG. 12D, showing shoulder straps for wearing and carrying the blind in the folded configuration.

FIG. 12F is a side elevational view of the hunting blind in the folded configuration shown in FIG. 12E.

Figure 13:
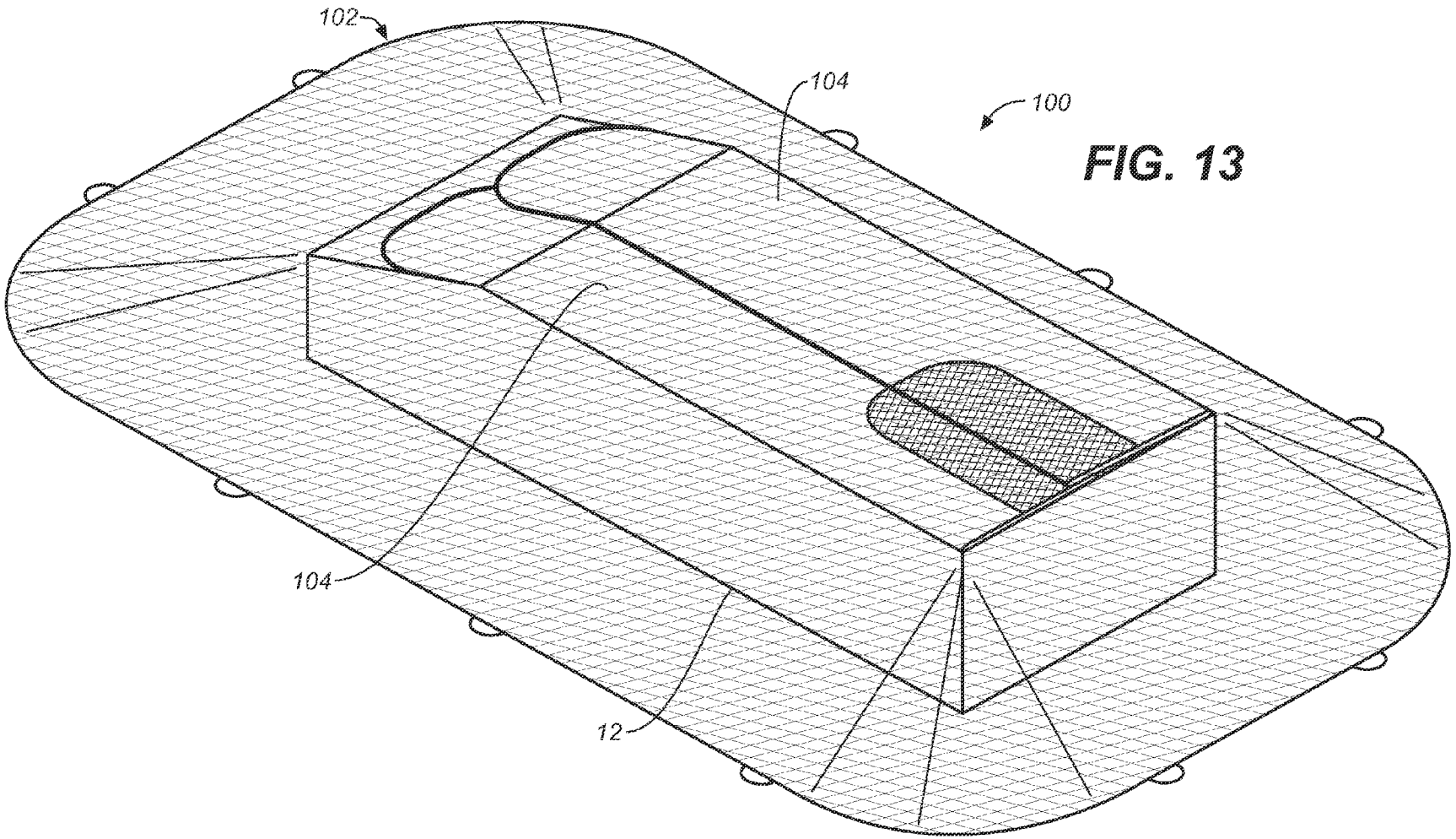

FIG. 13 is an upper perspective view of a hunting blind skirt, comprising door sleeves and an integrated skirt, covering a generic lay-down type hunting blind enclosure according to the invention.

Figure 13A:
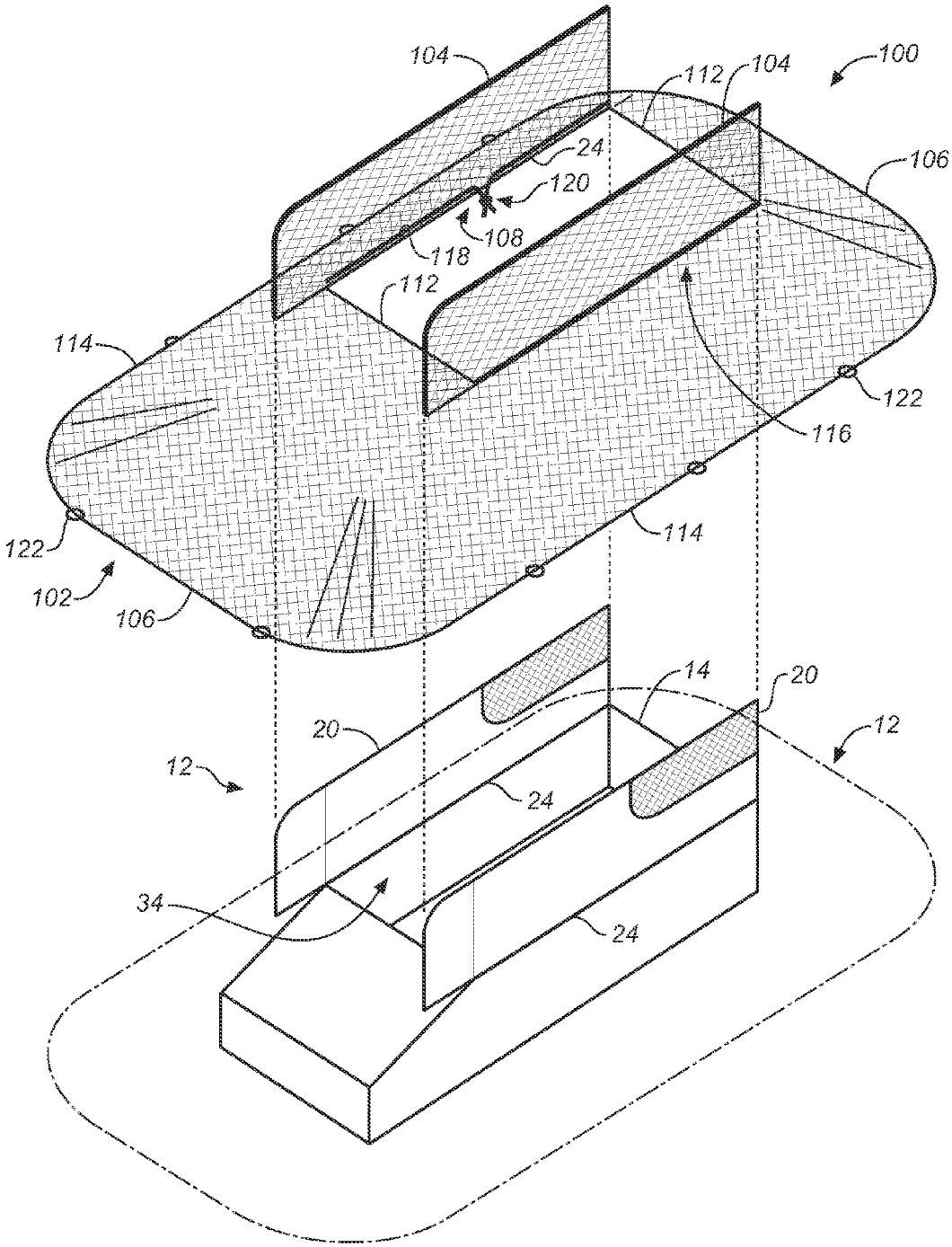

FIG. 13A is an exploded upper perspective view of the hunting blind skirt and lay-down type hunting blind enclosure shown in FIG. 13.

Figure 13B:
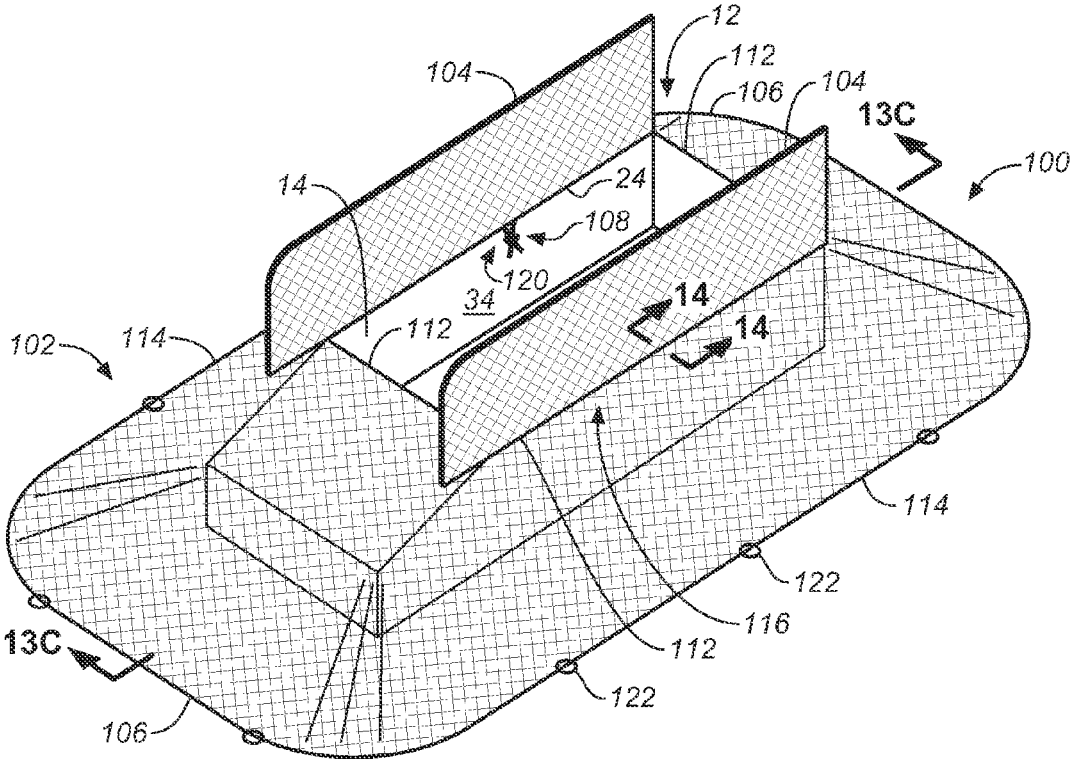

FIG. 13B is an upper perspective view of a hunting blind skirt shown in FIGS. 13 and 13A.

Figure 13C:
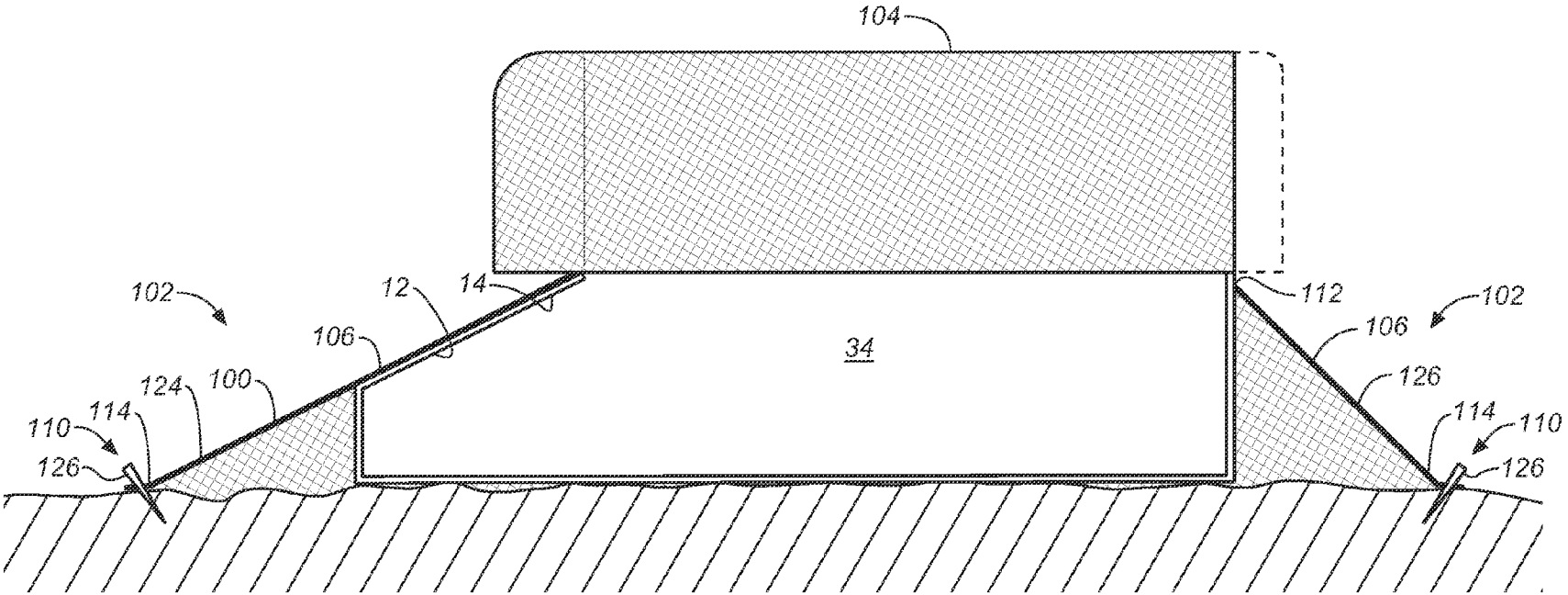

FIG. 13C is a longitudinal sectional view of the hunting blind skirt shown in FIG. 13B taken along lines 13C-13C.

Figure 14:
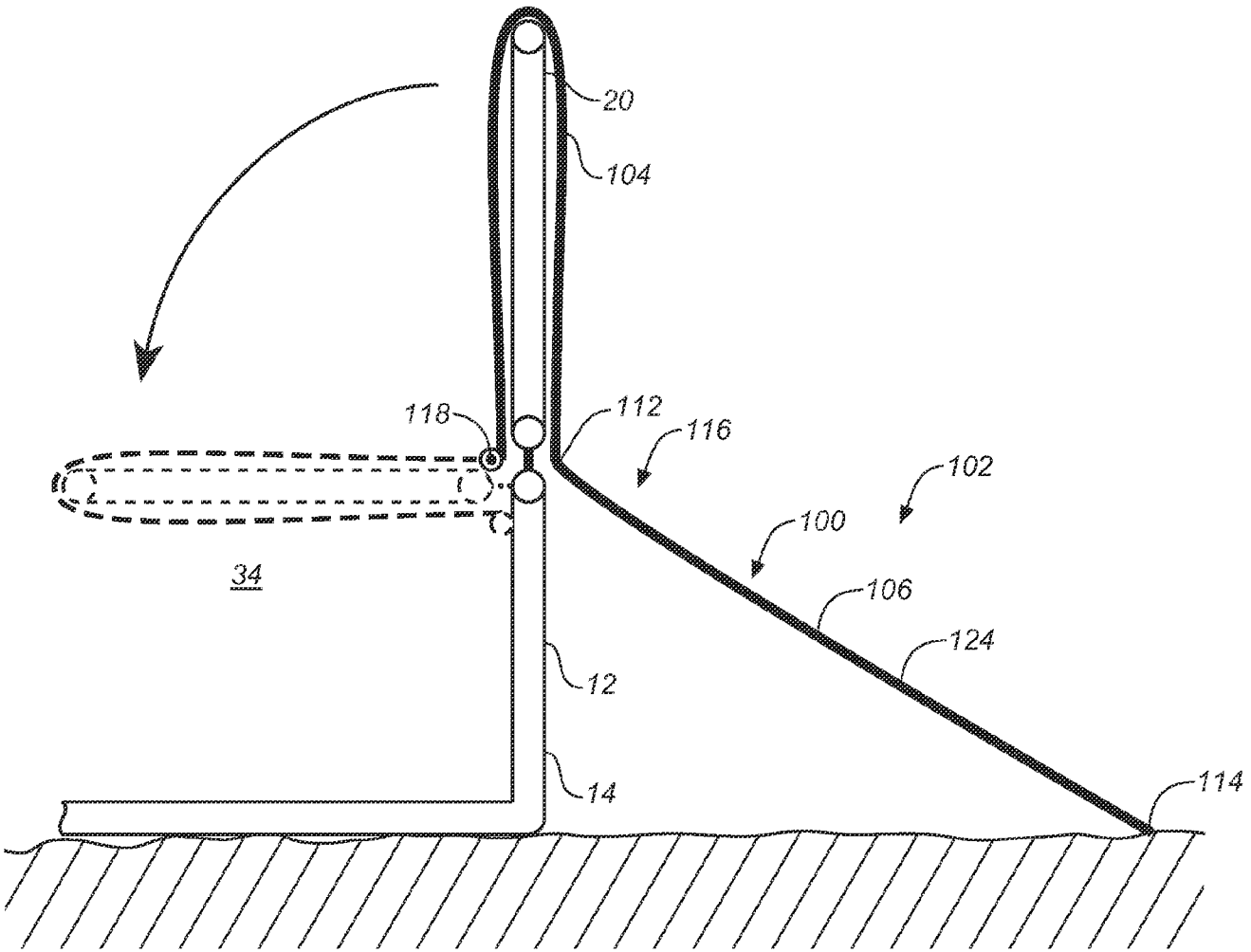

FIG. 14 is a cross-sectional view of a portion of the hunting blind shown in FIG. 13B taken along lines 14-14.

Figure 15A:
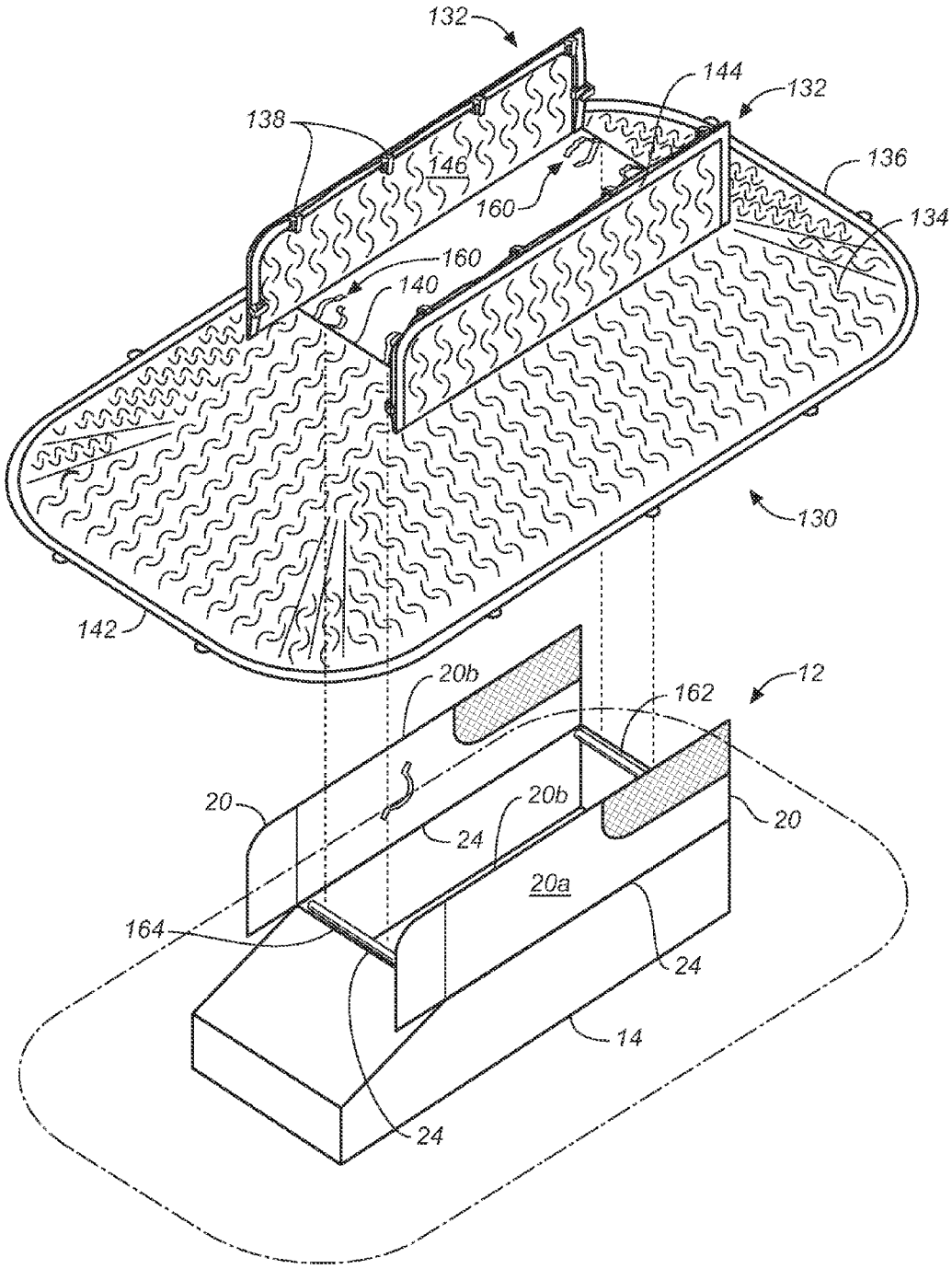

FIG. 15A is an exploded upper perspective view of a hunting blind skirt comprising door cover flaps and an integrated skirt, covering a generic lay-down type hunting blind enclosure according to the invention.

Figure 15B:
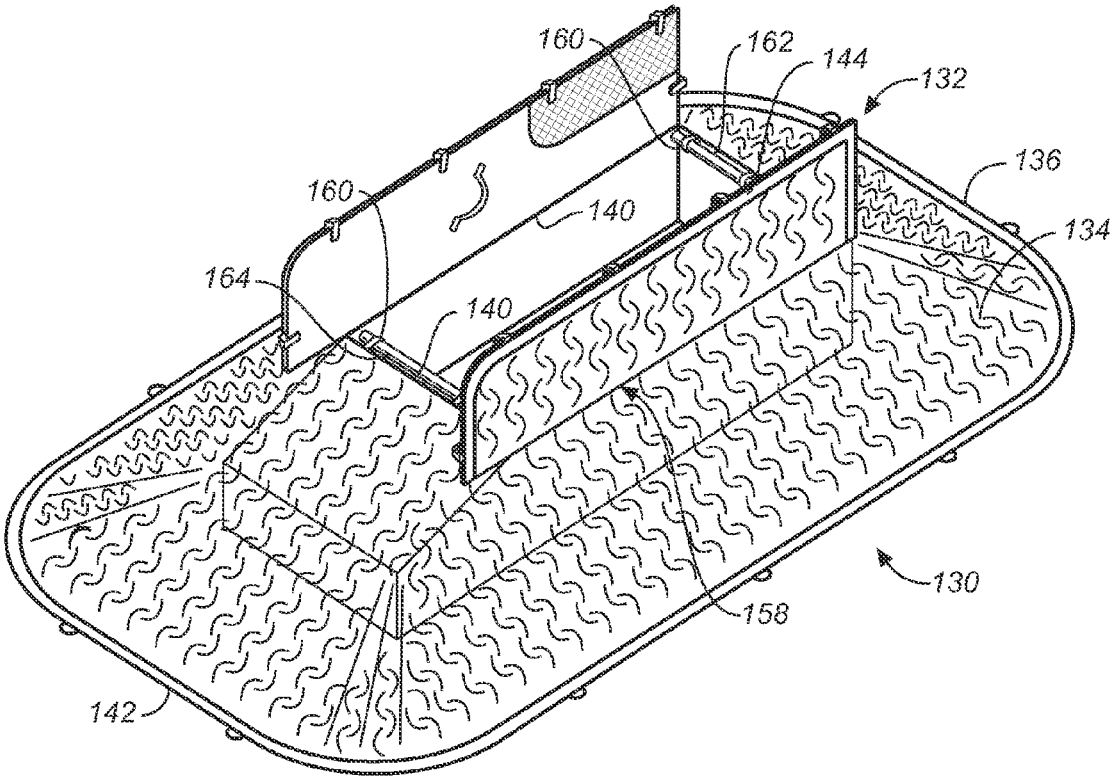

FIG. 15B is an upper perspective view of a hunting blind skirt shown in FIG. 15A.

Figure 16:
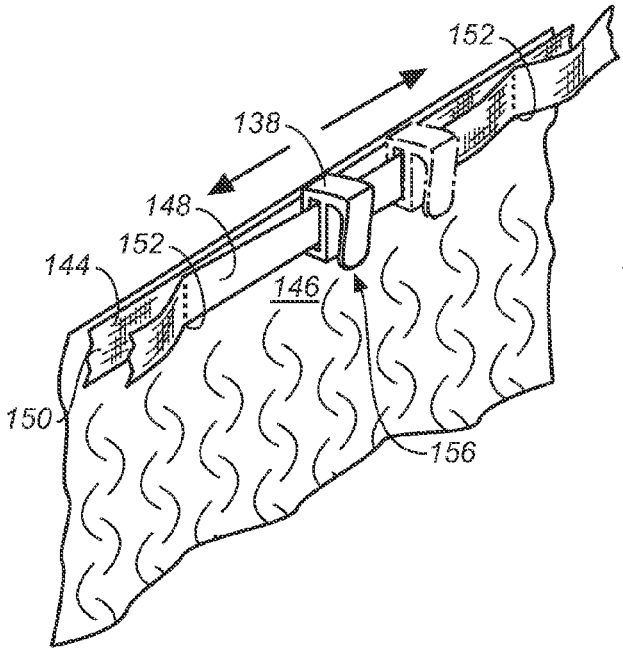

FIG. 16 is an upper perspective view of clips secured to a strip on the undersurface of one of the cover flaps.

Figure 17:
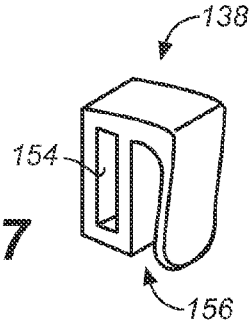

FIG. 17 is an upper perspective view of one of the clips shown in FIG. 16.

DESCRIPTION OF THE ILLUSTRATED EMBODIMENTS

An attachable skirt for use with hunting blind is generally indicated at 10 in FIG. 1A. It is contemplated that the skirt 10, according to the invention, will primarily be used with a lay-down type hunting blind enclosure 12 (hereinafter referred to as the "hunting blind 12") such as that shown in FIG. 1A, having a shell body 14 with a bottom panel for resting on a ground surface (see, e.g., FIGS. 4B, 5A and 5B), substantially vertical walls 16 extending upwardly from the bottom panel, a top panel 18 having flap doors 20 providing access to the interior of the shell 14, and an internal support framework (not shown), which in an assembled configuration holds the shell 14 in the form of an elongated enclosure of a size appropriate for accommodating an occupant in a recumbent position. The lay-down blind shown in the illustrations includes flap doors 20 that have overlapping free ends. Those of skill in the art will recognize that the skirt may be used in a suitable reconfiguration with other hunting blinds having various configurations, dimensions and footprints (e.g., square or octagonally-shaped blinds).

Figure 2:
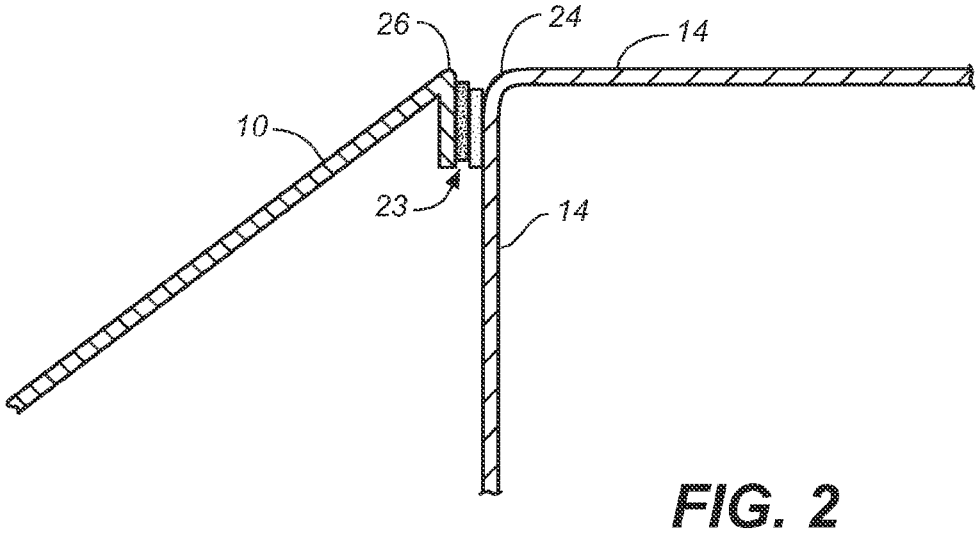
FIG. 2 is a sectional view of a portion of the skirt and hunting blind enclosure combination shown in FIG. 1B taken along lines 2-2.

Referring to FIG. 2, the skirt 10 comprises at least one flexible skirt panel 22, an attachment mechanism 23 for securing the skirt 10 to the shell 14, and a fastening mechanism for securing the panel 22 to a ground surface. In an alternate embodiment depicted in FIGS. 3A-3B, generally indicated at 100, the skirt 10 is fully integrated with the shell 14. In either embodiment, the skirt 10 may be formed from a single panel 22, as shown in FIG. 1A, or from multiple panels. Multiple panels may be connected at particular locations such that they are fully integrated into a single panel or they may be only partially attached to each other. Alternatively, a plurality of disconnected panels may be attached to the shell 14 in close proximity to one another, thus collectively forming a skirt around the shell.

In the illustrated embodiments, the skirt as shaped and sized to either substantially or completely surround the hunting blind. In the embodiment shown in FIGS. 6 and 7, the skirt 10 extends entirely around the lay-down enclosure or hunting blind 12. Fully surrounding the enclosure 12 with the skirt minimizes shadows in all directions and maximizes integration of the retrofitted blind into the environment. Another embodiment shown in FIG. 6A is similar to that shown in FIG. 6 except that, instead of a single uniform panel, skirt 10 is comprised of separate head end, side and toe end panels 22H, 22S and 22T, respectively, each disconnected from the other at panel ends 21. The adjacent ends 21 of each pair of adjacent panels thus form a gap or opening 25 providing access to the ace underneath the skirt 10.

Figure 1C:
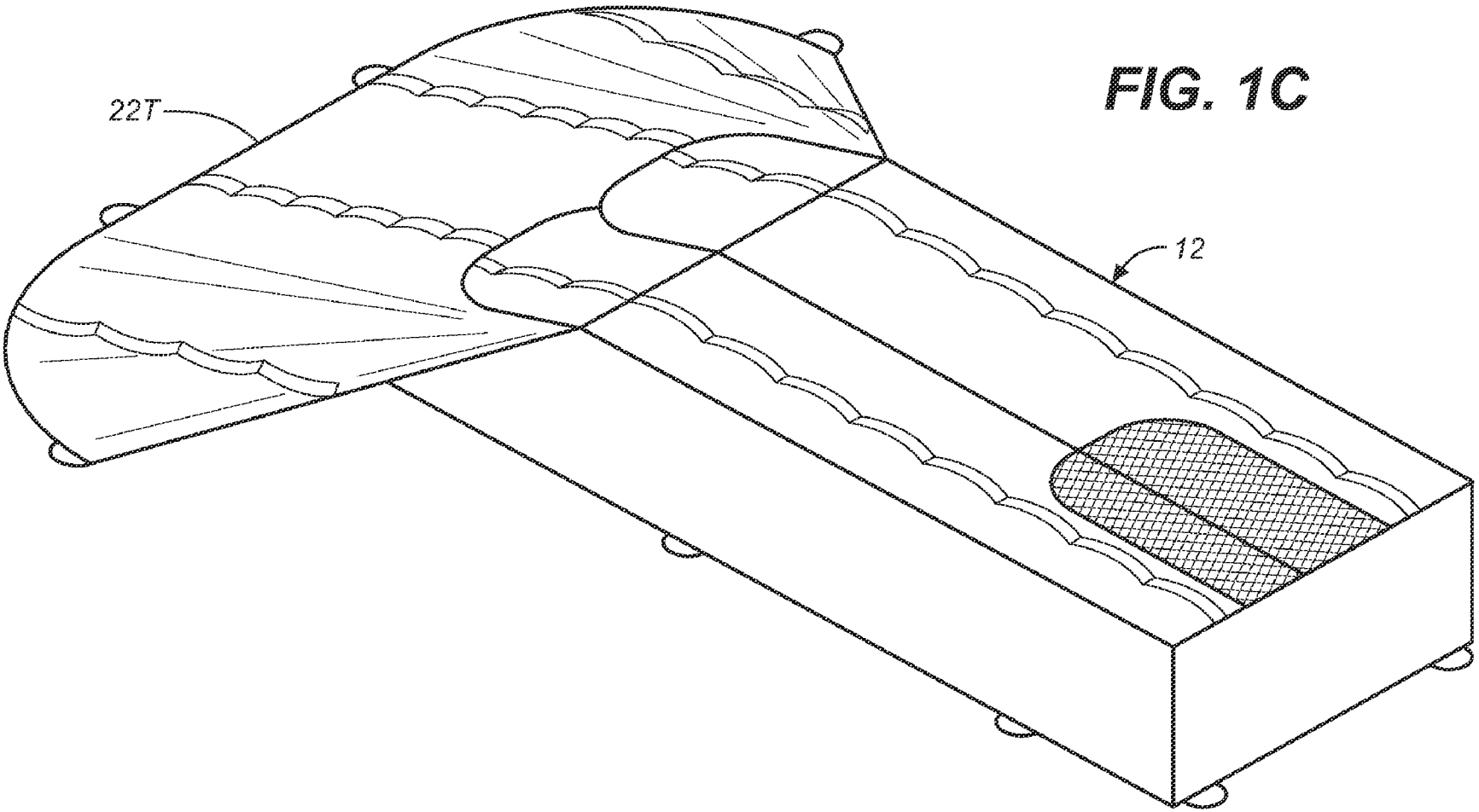
FIG. 1C is an upper perspective view of a hunting blind enclosure and skirt similar to that shown in FIG. 1B wherein the skirt extends from the toe end of the blind.
Figure 1D:
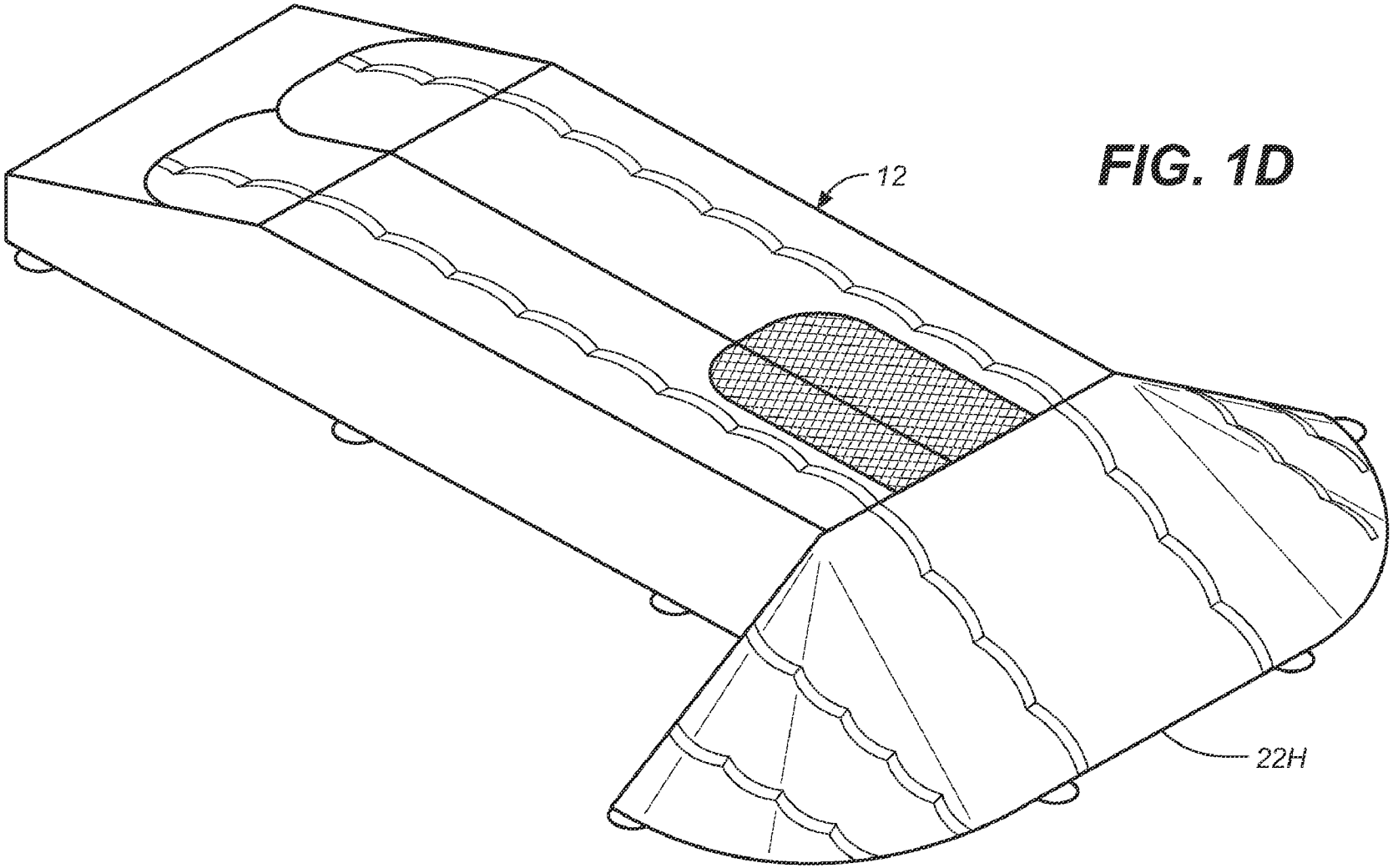
FIG. 1D is an upper perspective view of a hunting blind enclosure and skirt similar to that shown in FIG. 1B wherein the skirt extends from the head end of the blind.
Figure 1E:
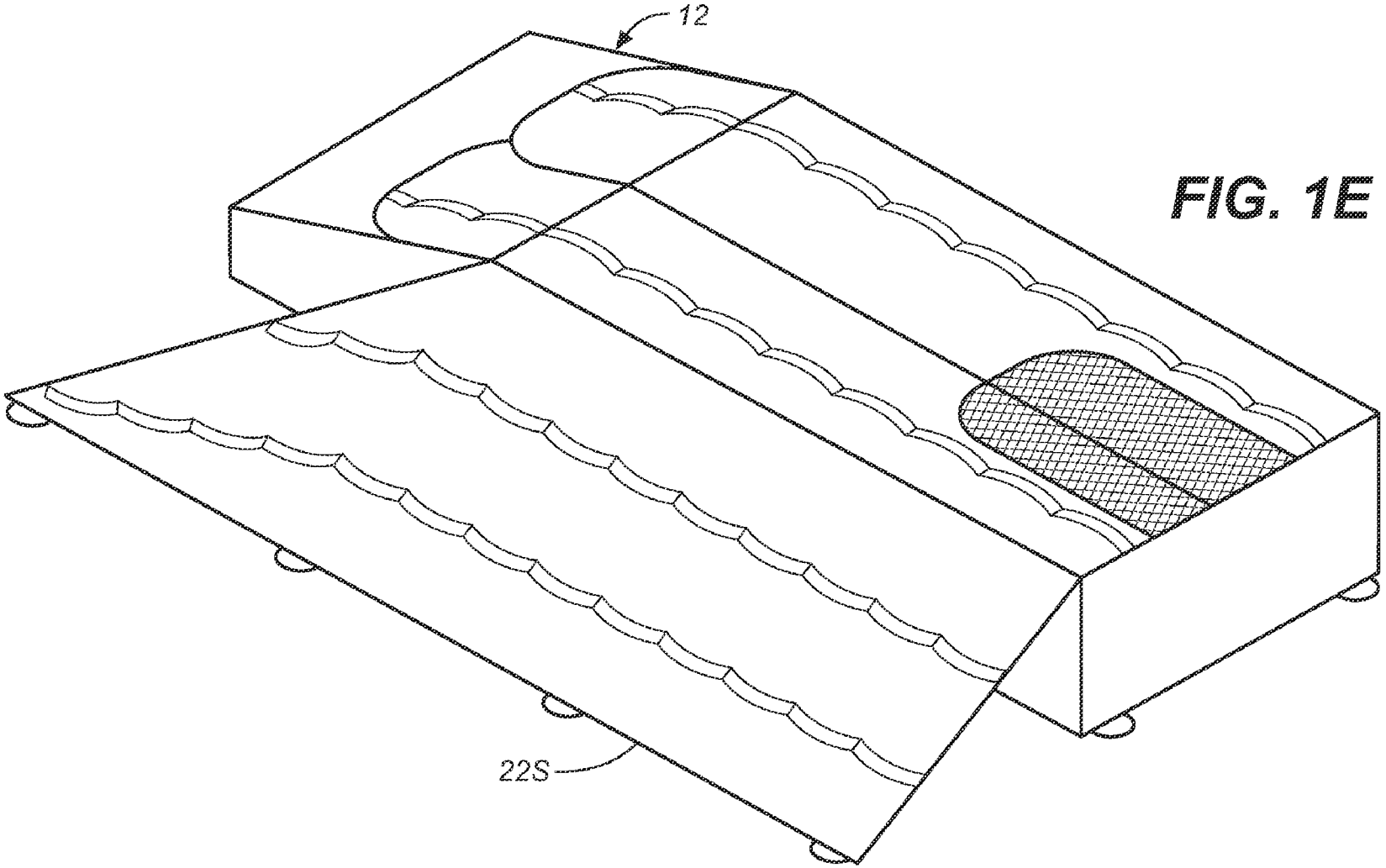
FIG. 1E is an upper perspective view of a hunting blind enclosure and skirt similar to that shown in FIG. 1B wherein the skirt extends from one side of the blind.

Alternate embodiments of skirts for use with hunting blinds are shown in FIGS. 1C-1E. In the embodiment shown in FIG. 1C, toe end skirt 22T is attached to the toe end of the hunting blind 12. In the embodiment shown in FIG. 1D, head end skirt 22H is attached to the head end of the hunting blind 12. In the embodiment shown in FIG. 1E, side skirt 22S is attached to one side of the hunting blind 12. It will be understood by those of skill in the art that other embodiment may consist of any combination of the head end, side and toe end panels 22H, 22S and 22T. It should also be understood that adjacent panel ends 21 may abut each other, be slightly separated, or overlap. Each of the panels 22H, 22S and 22T may themselves comprise a plurality of smaller subpanels.

With reference now to FIG. 1A, the vertical walls 16 of the shell of a conventional lay-down hunting blind 12 generally define a top perimeter edge 24. The top of the skirt panel 22 forms a proximate edge 26 for attaching to the shell's top perimeter edge 24. The shell's top perimeter edge 24 includes two panel top side edges 28 extending between a head edge 30 and a toe edge 32. The proximate edge 26 of the skirt panel 22 is dimensioned for extension along and attachment to at least the panel top side edges 28 and the toe edge 32, thereby defining an opening 34 conforming to the top perimeter edge 24 of the shell 14.

When the proximate edge 26 of the skirt panel 22 is attached to the top perimeter edge 24 of the she 14, as shown in FIGS. 1B and 2, the skirt panel 22 may be stretched away from the she 14 and, once the distal edge 36 of the panel 22 is secured to a ground surface G, the panel 22 assumes a gradual slope 38, as shown in FIGS. 4A, 4B, 5A, and 5B. Applicants have determined that a slope of between about forty-five and about seventy-five degrees from a vertical plane minimizes shadows, blends better into the natural environment, minimizes the amount of material needed to manufacture the panel, and provides a triangularly shaped enclosure surrounding the shell which can be used as additional storage space. Slopes outside this range are also intended to fall within the scope of the invention.

In one embodiment, the flexible material from which the panel 22 for the skirt 10 is constructed is a tightly woven waterproof fabric, such as those commonly used for tents and camping backpacks. Fabric suitable for manufacturing the skirt may include, for example, polyvinyls, coated fabrics, and laminated fabrics. Alternatively, the panel 22 could be constructed from a netting or an open-weave material, especially if such a material can hold camouflaging material as discussed below. It is recognized that other flexible materials suitable for outdoor use may be used to construct the skirt panel 12 or panels and need not necessarily be waterproof.

With reference to FIG. 2, any number of devices may be used to attach the proximate edge 26 of the skirt panel 22 to the top perimeter edge 24 of the shell 14, such as ties, clips, hook-and-loop type fasteners, clasps, bands, and straps, as long as the skirt 10 is attachable to and detachable from the shell.

The bottom or distal edge 36 of the panel 22 may be secured to a ground surface G by means such as those commonly used to secure a tent to the ground. As shown in FIG. 1A, the panel 22 has periodically spaced staking loops 40 extending outward from the panel's distal edge 36. Tent stakes or the like may be passed through loops 40 to secure the distal edge 36 of the panel 22 to a ground surface G, as seen in FIGS. 4A-4B, 5A-5B, and 7. Alternative methods may be used to secure the distal edge 36 to the ground according to the circumstances in the field and as may be convenient.

Referring back to FIG. 1A, like a hunting blind, the skirt 10 is intended to provide camouflage for blending in with natural environments such as marshlands, fields, and wooded areas. Thus, the skirt panels 22 may include flexible loop-like constructions 42 extending from the outer surface 44 of the skirt 10 for holding camouflaging material such as brush, branches and leaves. Other structures and methods suitable for securing camouflaging material to the skirt 10 are also contemplated.

A particular advantage of the skirt 10 is that it does not interfere with the normal field usage of a lay-down hunting blind 12. With reference to the embodiment of the invention illustrated in FIGS. 3B, 5A and 5B, although the skirt panel 22 is attached to the side panel top edges 28 of the side panels 16S of the shell body 14, the flap doors 20 can be rapidly moved from the closed position, shown in FIG. 5A, to an open position, such as that shown in FIG. 5B, without disturbing the placement of the skirt panel 22 or requiring any time consuming reconfiguration of the blind.

With reference now to FIGS. 8A, 8B and 9, a collapsible housing 50 dimensioned to enclose a hunting dog may optionally be integrated with or attached to the shell 14 at the head end 52 or toe end 54 of the shell 14. The housing 50 is dimensioned to conceal and protect a hunting dog or to serve as additional equipment storage space. While the illustrations show the housing 50 attached to the head end 52 of the shell 14, it may be attached at convenient alternative locations around the perimeter of the shell 14.

The housing 50 is formed from a flexible sheet-like material folded into a U-shape or overlapping configuration defining upper and lower sections 58, 60. An inner wall 61 of the housing 50 abuts the head panel 15 of the shell 14 as best shown in FIG. 11. An upper edge 62 and upper corners 64 of the upper section 58 abut the head edge 30 of the shell 14, as shown in FIG. 8B. The lower section 60 has a lower inner edge 65 (see FIG. 9), lower inner edge corners 66, lower outer edge 68, and lower outer edge corners 70 (see FIG. 8B). The sheet-like material may be of any type that is flexible and suitable for outdoor use.

The housing 50 includes means 71 for attaching the upper edge 62 of the housing 50 to the shell 14 (see FIG. 11), means 72 for fastening the lower inner edge 65 to the shell 14, and means 73 for securing the lower outer corners 70 to a ground surface G to create a sloping upper surface generally consistent with the slope 38 of skirt 10 discussed above. Means 71 and 72 are most likely hook-and-loop type fasteners, but numerous other types of fasteners could be used, such as ties, clips, clasps, bands, and straps, that allow the housing 50 to be attached and detached from the shell 14 without extraordinary time and effort. Means 73 as illustrated are loops such as those extending from skirt 10 discussed above.

FIG. 8A depicts how stretching the upper section 58 between the upper corners 64 and the lower outer corners 70 suspends the upper section 58 above the lower section 60 to form the housing 50 into an open configuration and define two lateral entry ports 74. When so stretched, tension lines 76 extend between the lower outer corners 70 and upper corners 64. Folding flap doors 78 depending from the tension lines 76 substantially cover the lateral entry ports 74.

As shown in FIGS. 8A and 10, a flexible support frame 80 having enough rigidity to retain a fixed bent position is embedded in the upper section 58 in stitched sleeves 81 to provide structural support for the upper section 58 of the housing 50. In particular, the frame 80 helps support the housing's folded sheet-like material in an open configuration. The frame 80 may be constructed from bendable wire or other suitable material that is flexible yet rigid enough to reinforce the upper section 58 in the open configuration. The frame 80 utilizes a plurality of bendable wires, one or more lateral support wires 82 extending between the upper edge 62 and lower outer edge 68, and one or more transverse wires 84 extending between or from one or more of the lateral support wires 82. With the lateral support wires 82 generally aligned with tension lines 76, stretching the upper section 58 between the upper corners 64 and the lower outer edge corners 70, as discussed above, bends the lateral support wires 82 roughly into alignment with the tension lines 76 and helps support the upper section 58. This movement correspondingly pulls the middle of the upper section 58 between its two lateral edges and bends the transverse wire 84 so that it extends between the lateral support wires 82 and further helps to support the upper section 58 of the housing 50. In one embodiment, the wires are sufficiently flexible that when a dog burrows into the enclosure, any outward pressure exerted by the dog will further bend the wire framework 80 outward to conform to and help accommodate the body size of the dog.

Disassembly of the blind 12 is depicted in FIGS. 12A-12F. After the internal frame has been disassembled, the shell 14 may be collapsed so that the skirt 10 and shell 14 together form a substantially flat configuration as shown in FIG. 12A. Thereafter, a first longitudinal section 86 is folded over a middle section as shown in FIG. 12B. A second longitudinal section 88 is then folded over to at least partially overlap the first longitudinal section 86 forming a folded configuration as shown in FIG. 12C. Next, the toe end 54 of the blind is folded upwards towards the head end 52, as shown in FIG. 12D, forming a backpack configuration having a square or rectangular shape, and is secured with belts 90 having a connecting or locking mechanism 92. Referring to FIGS. 12E-12F, the folded hunting blind can now be turned over and worn like a backpack by using the shoulder straps 94 disposed on the bottom outer surface 96 of the shell 14. The entire disassembly and assembly processes each take just a few minutes. The process would be similar for a skirt and blind combination which includes a dog housing 50.

In another embodiment shown in FIG. 13, an attachable hunting blind skirt 100 integrated with flap door sleeves 104 is shown covering a generic lay-down type hunting blind 12. The skirt 100 is dimensioned to surround the entire hunting blind 12. Though shown in use with a lay-down type hunting blind 12, the skirt 100 may be configured for use with other blinds having various shapes and sizes, and may optionally be fully integrated with the hunting blind. The illustrated skirt 100 is a webbed or open-weave fabric, but could comprise many flexible fabrics including woven and non-woven fabrics.

Referring to FIGS. 13B, 13C, and 14, the hunting blind skirt 100 comprises at least one flexible skirt panel 106 for covering the majority of the blind shell body 14, sleeves 104 extending from the skirt panel 106 dimensioned for closely enclosing the blind's flap doors 20, a tightening mechanism 108 for retaining the flap doors 20 in the sleeves 104, and a fastening mechanism 110 for securing the skirt 100 to a ground surface.

The skirt panel 106 has a proximate edge 112 and a distal edge 114. By inserting the flap doors 20 into the sleeves 104 such that the doors 20 are fully enveloped by the sleeves 104, the proximate edge 112 of the skirt panel 106 aligns with the top perimeter edge 24 of the hunting blind opening 34. The skirt panel 106 meets each flap door sleeve 104 at a hinging or folding region 116 such that the flap door 20 may be freely opened and closed unimpeded by the flap door sleeve 104. In the embodiment illustrated in FIG. 13A, the sleeves 104 are secured around the doors 20 by a tightening mechanism 108, which includes a drawstring cord 118 with a suitable type of tightener device 120. When fully deployed, the flap door sleeves 104 envelope the flap doors 20 and the skirt panel 106 covers the rest of the blind's shell 14. The skirt panel 106 may then be stretched away from the shell body 14 and its distal edge 114 secured to a ground surface by means of a fastening mechanism 110 indicated in FIG. 13C, resulting in the panel 106 assuming a gradual slope 124. The fastening mechanism may include stake loops 122 (see FIGS. 13-13B) and stakes 126 (see FIG. 13C).

Yet another embodiment of a camouflaged hunting blind having an attachable skirt 130 and integrated door covering flaps 132 for covering, fully surrounding and camouflaging a generic lay-down type hunting blind 12 is shown in FIG. 15A. The fabric used for constructing skirt 130 is of a type suitable for rugged outdoor use, and may include appropriate appliques 134 to enhance its camouflaging properties. Those of skill in the art will recognize that skirt 130 need not be limited to use with a lay-down type hunting blind 12, and may be configured for use with blinds and containers of various shapes and dimensions having top-opening doors.

Referring to FIGS. 15B, 16 and 17, the hunting blind skirt 130 comprises at least one flexible skirt panel 136 for camouflaging the blind's shell body 14, inwardly extending cover flaps 132 for covering the flap doors 20, and a plurality of clips 138 for securing the cover flaps 132 over the flap doors 20.

The skirt panel 136 has a proximate edge 140 and a distal edge 142. The proximate edge 140 is dimensioned to align with and conform to the top perimeter edge 24 of the shell body 14. The cover flaps 132 extend inwardly laterally from the lengthwise sides of the proximate edge 140 of the skirt panel 136, and are dimensioned to fully cover the outside surface 20*a* of the flap doors 20. Each cover flap 132 of the illustrated embodiment has a hemmed edge 144 and an undersurface 146. It will be understood that the cover flaps 132 could extend beyond the edges of the flap doors 20 if desired. A strip 148 with a number of clips 138 secured to it is attached to the bottom side 150 of the hemmed edge 144 at various intervals 152. In the illustrated embodiment, the clip 138 has a generally shape G-shaped geometry having an opening 154 in which to receive the strip 148 and a slot 156 to grip a section of one of the flap doors 20. In the illustrated embodiment, the strip 148 is freely received in the opening 154 such that the clip 138 can be moved to any desired position along the strip 148 as shown in FIG. 16. The slot 156 may be rigid or semi-flexible and may incorporate a locking element for securely gripping the strip 148 or for adjusting the gripping tension of the clip 138 on the strip 148. The clips 138 are constructed from a suitable material such as plastic or metal. Hook-and-loop type fasteners 160 are provided at the head and toe edges of the proximate edge 140 of the skirt for holding onto the head and gun rests 162, 164 of the shell body 14.

The skirt 130 is used by placing it over the blind 12 and aligning the cover flaps 132 to cover the flap doors 20. The cups 138 are then slipped over the free edge 20*b* of the flap doors 20 so that the clips 138 grip and hold the cover flaps 132 over the flap doors 20. In this configuration the proximate edge 140 of the skirt panel 136 is closely aligned with the top perimeter edge 24 of the hunting blind opening 34 (see FIG. 13A) and the cover flaps 132 overlay the flap doors 20. The covered flap doors 20 may be freely opened and closed since the cover flaps 132 easily bend about a hinging or folding region 158. The head and toe edges of the proximate edge 140 are secured to the shell body 14 by closing the hook-and-loop fasteners 160 over the head and gun rests 162, 164 as shown in FIG. 15B. Once the proximate edge 140 is in this manner secured to and around the top perimeter edge 24, the distal edge of the skirt panel 136 may then be stretched away from the shell body 14 and secured to a ground surface forming a substantially tapered or sloped panel 136.

A significant advantage of the invention is that retrofitting a conventional lay-down type hunting blind with a skirt or skirting, or fully integrated lay-down hunting blind with skirting, gives the blind a gradually sloped overall profile which eliminates unwanted shadows that deter waterfowl from approaching the blind and otherwise camouflages the blind. Skirting adds little additional weight to that of the lay-down type blind enclosure such that the entire assembly may be carried by an individual to a desired location in the field. Moreover, a hunting blind outfitted with skirting according to the invention will blend more naturally into the environment and, consequently, be more effective.

While embodiments of a skirt for a lay-down type hunting blind have been described and illustrated, it will be recognized and appreciated by those skilled in the art that modifications thereof are within the true spirit and scope of the invention. The appended claims are intended to cover all such modifications.

We claim:

1. A lay-down hunting blind having a gradually sloped profile, the lay-down blind having an elongated fabric shell and a rigid interior framework disposed inside the shell, the framework having an assembled configuration for holding the shell in the form of an elongated enclosure sized for accommodating an occupant in a recumbent position, the hunting blind comprising:

the fabric shell having two opposing vertical side panels, an interior, and a top opening providing the occupant access to said interior, said side panels having top panel side edges, said top opening defined laterally by said top panel side edges, a pair of flap doors, each said flap door having a hinge edge, said hinge edges attached to the top panel side edges of said side panels such that said pair of flap doors are foldable about said top panel side edges to a closed position in which said doors cover the top opening of the shell, said pair of flap doors foldable outwardly about said top panel side edges from said closed position to an open position for allowing the occupant rapid egress from the interior of the shell, at least one flexible skirt panel having a proximate edge and a distal edge, said proximate edge attached to the top panel side edge of at least one of said side panels, in a deployed configuration said skirt panel extending outwardly from said top panel side edge at an acute angle relative to said at least one of said side panels and said distal edge adapted to be secured to a surrounding ground surface, whereby, when said at least one skirt panel is in said deployed configuration, said pair of flap doors are independently movable between said open and closed positions free of interference from said at least one skirt panel, and when said flap doors are in said closed position the blind has a gradually sloped vertical profile.

2. The hunting blind of claim 1 wherein:

said top opening having a toe edge extending between said top panel side edges, the proximate edge of said at least one flexible skirt panel dimensioned for extending at least along said top panel side edges and said toe edge of said top opening.

3. The hunting blind of claim 2 wherein:

the flap doors open and close around a fold line coincident with the two side panel top edges of said top perimeter edge.

4. The hunting blind of claim 1 wherein:

said at least one skirt panel comprises a tightly woven fabric.

5. The hunting blind of claim 4 wherein:

said fabric is waterproof.

6. The hunting blind of claim 1 further comprising:

an attachment mechanism for detachably securing said proximate edge of said skirt panel to said top edges of said side panels.

7. The hunting blind of claim 1 wherein:

said at least one skirt panel has a slope of at least about forty-five degrees relative to a vertical plane.

8. The hunting blind of claim 1 further comprising:

means for securing said distal edge to a ground surface.

9. The hunting blind of claim 8 wherein:

said means for securing said distal edge to a ground surface includes stake loops positioned at spaced intervals along said distal edge such that tent stakes may be placed through said stake loops and into a ground surface.

10. The hunting blind of claim 1 further comprising:

means for attaching brush to said at least one skirt panel.

11. The hunting blind of claim 10 wherein:

said at least one skirt panel has a top surface, and said means for attaching brush to said at least one skirt panel includes one or more flexible loops fastened to said top surface.

12. The lay-down blind of claim 1 wherein:

said at least one skirt panel is for minimizing shadows cast by the vertical walls of the shell.

13. The lay-down blind of claim 1 wherein:

the shell, frame and at least one skirt panel can be carried by an individual to a selected field location.

14. The hunting blind of claim 1 wherein:

the flap doors having free edges that overlap when said doors are closed over the opening to the interior of said shell.

15. The hunting blind of claim 1 further comprising:

said shell having a bottom outer surface having shoulder straps, and wherein said shell has a collapsed configuration in which said internal framework has been disassembled, in said collapsed configuration said shell and said at least one skirt panel collectively forming a substantially flat configuration foldable to a size that is suitable to be worn using said shoulder straps, said substantially flat configuration having a middle section and opposite first and second longitudinal sections extending laterally from said middle section, said shell and at least one skirt panel collectively having folded and backpack configurations, in said folded configuration said first longitudinal section is folded over said middle section and said second longitudinal section is folded over said middle and first longitudinal sections, said folded configuration having a toe end and a head end, in said backpack configuration, while said shell and at least one skirt panel are in the folded configuration, said toe end is folded over said head end and secured in place with a locking mechanism leaving said shoulder straps exposed on said bottom outer surface such that said shell and at least one skirt panel may be worn like a backpack for transport by an individual.

* * * * *